US006873260B2

(12) United States Patent
Lancos et al.

(10) Patent No.: US 6,873,260 B2
(45) Date of Patent: Mar. 29, 2005

(54) SYSTEM AND METHOD FOR SELECTIVELY ALLOWING THE PASSAGE OF A GUEST THROUGH A REGION WITHIN A COVERAGE AREA

(76) Inventors: Kenneth J. Lancos, 12 Ramada, Irvine, CA (US) 92620; Thomas J. Land, 1996 Willow Tree Ct., Thousand Oaks, CA (US) 91362

( * ) Notice: Subject to any disclaimer, the term of this patent is extended or adjusted under 35 U.S.C. 154(b) by 100 days.

(21) Appl. No.: 09/967,667

(22) Filed: Sep. 28, 2001

(65) Prior Publication Data

US 2002/0082859 A1 Jun. 27, 2002

Related U.S. Application Data

(60) Provisional application No. 60/236,576, filed on Sep. 29, 2000.

(51) Int. Cl.[7] ..... G08B 23/00

(52) U.S. Cl. ..... 340/573.1; 340/5.2; 340/5.22; 340/5.24; 340/5.41; 340/573.4

(58) Field of Search ..... 340/573.1, 573.4, 340/5.8, 825.28, 5.4, 5.41, 825.38, 5.1, 5.2, 5.22, 5.24, 5.81

(56) References Cited

U.S. PATENT DOCUMENTS 4,806,743 A * 2/1989 Thenery ..... 235/462.45
4,877,947 A 10/1989 Mori
4,882,675 A 11/1989 Nichtberger et al. ..... 705/14
5,204,670 A 4/1993 Stinton
5,259,025 A 11/1993 Monroe et al. ..... 705/75
5,423,574 A 6/1995 Forte-Pathroff
5,432,864 A 7/1995 Lu et al. ..... 382/118
5,465,291 A 11/1995 Barrus et al. ..... 379/67.1
5,566,327 A 10/1996 Sehr ..... 707/104.1
5,694,514 A 12/1997 Evans et al.
5,856,931 A 1/1999 McCasland ..... 702/182

(Continued)

OTHER PUBLICATIONS

Toll Collection: System E Comes To Maine Turnpike, Advanced Transportation Technology News, VI, N6, Jul. 1, 1996.

*Primary Examiner*—Daniel J. Wu
*Assistant Examiner*—Son Tang

(57) ABSTRACT

A system and method for selectively allowing the passage of a guest through a region within at a coverage area. The system includes a turnstile system having an RFID reader, a network interface, an entry mechanism and a processor, and a central server having a network interface, a non-volatile memory, and a processor. An RFID reader reads a tag identifier from an RFID tag worn by a guest. The tag identifier is transmitted from the turnstile system to the central server. The central server processor access a guest data object using the tag identifier and reads a data field containing information related to the guest. Based on this information, the central server transmits a control signal to the turnstile system to activate its entry mechanism, thereby allowing the guest to pass through. The information may relate to monetary credits of the guest, statistical information of the guest, and restrictions, disabilities, health conditions and special access of the guest.

9 Claims, 14 Drawing Sheets

U.S. PATENT DOCUMENTS 5,859,779 A 1/1999 Giordano et al.
5,869,826 A 2/1999 Eleftheriou ..... 235/380
5,886,634 A * 3/1999 Muhme ..... 340/5.31
5,905,249 A 5/1999 Reddersen et al. ..... 235/462.1
5,918,211 A 6/1999 Sloane ..... 705/16
5,936,527 A 8/1999 Isaacman et al. ..... 340/572.1
5,946,444 A 8/1999 Evans et al. ..... 386/46
5,978,493 A * 11/1999 Kravitz et al. ..... 283/75
5,979,941 A 11/1999 Mosher, Jr. et al.
5,987,421 A 11/1999 Chuang
6,044,349 A * 3/2000 Tolopka et al. ..... 380/277
6,057,764 A * 5/2000 Williams ..... 340/10.42
6,084,513 A 7/2000 Stoffer
6,100,804 A 8/2000 Brady et al.
6,100,806 A 8/2000 Gaukel
6,129,274 A 10/2000 Suzuki ..... 236/21 R
6,164,535 A 12/2000 Goodwin, III ..... 235/383
6,179,206 B1 1/2001 Matsumori ..... 235/383
6,220,515 B1 4/2001 Bello ..... 235/487
6,232,877 B1 * 5/2001 Ashwin ..... 235/384
6,265,977 B1 7/2001 Vega et al. ..... 340/572.7
6,275,681 B1 8/2001 Vega et al. ..... 455/41.1
6,282,407 B1 8/2001 Vega et al. ..... 455/41.1
6,300,872 B1 * 10/2001 Mathias et al. ..... 340/5.2
6,340,116 B1 * 1/2002 Cecil et al. ..... 235/380
6,345,263 B1 * 2/2002 Matsumoto et al. ..... 705/41
6,351,215 B2 * 2/2002 Rodgers et al. ..... 340/572.1
6,424,264 B1 7/2002 Giraldin et al. ..... 340/573.1
6,450,407 B1 9/2002 Freeman et al. ..... 235/492
6,484,146 B2 11/2002 Day et al. ..... 705/14
6,484,947 B1 11/2002 Miyata ..... 235/492
6,490,409 B1 12/2002 Walker ..... 386/117
6,502,749 B1 1/2003 Snyder ..... 235/383
6,505,772 B1 1/2003 Mollett et al. ..... 235/579
6,608,563 B2 8/2003 Weston et al. ..... 340/573.1
6,609,655 B1 * 8/2003 Harrell ..... 235/380
6,629,019 B2 9/2003 Legge et al. ..... 700/237
6,657,543 B1 * 12/2003 Chung ..... 340/573.1
2001/0018660 A1 * 8/2001 Sehr ..... 705/5

* cited by examiner

FIG. 8
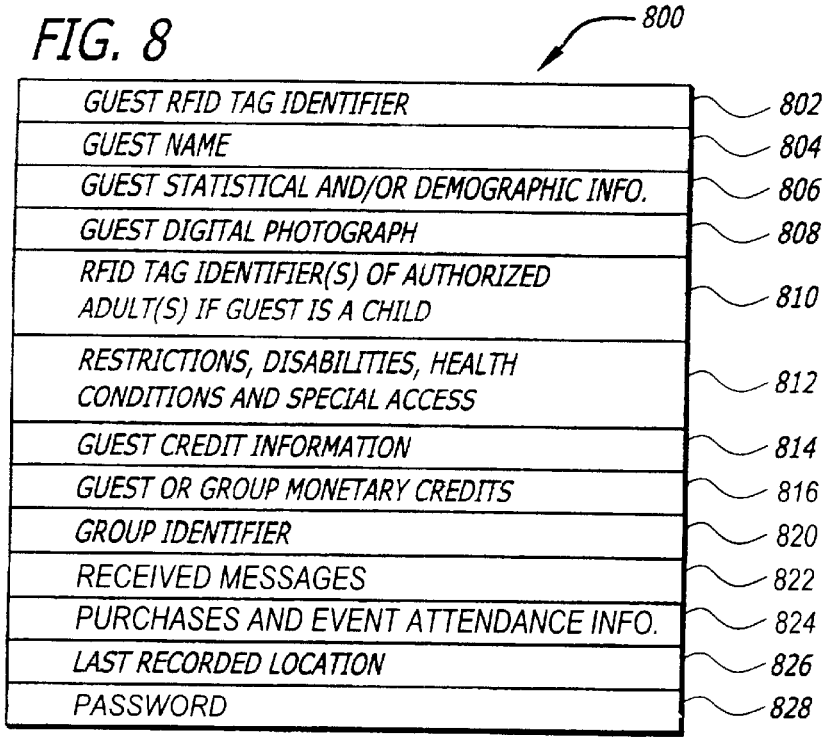
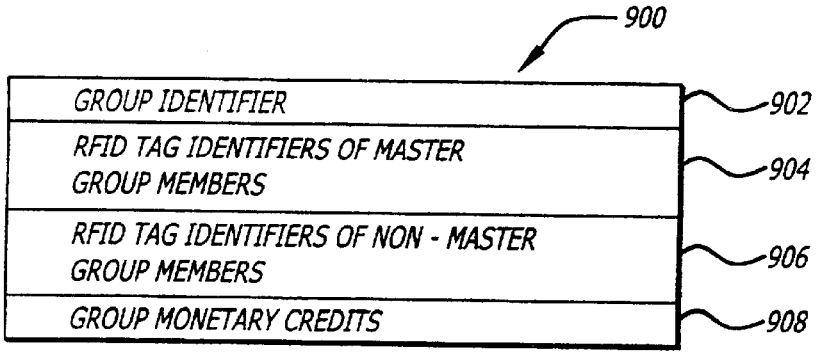
FIG. 9
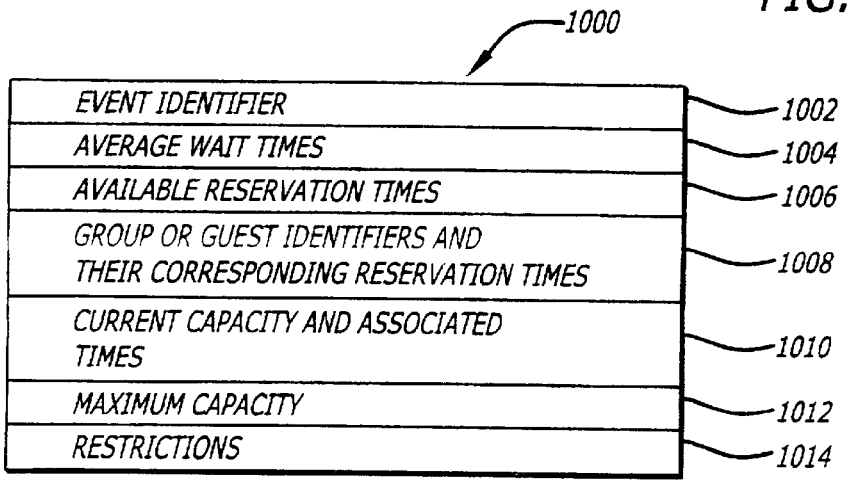
FIG. 10

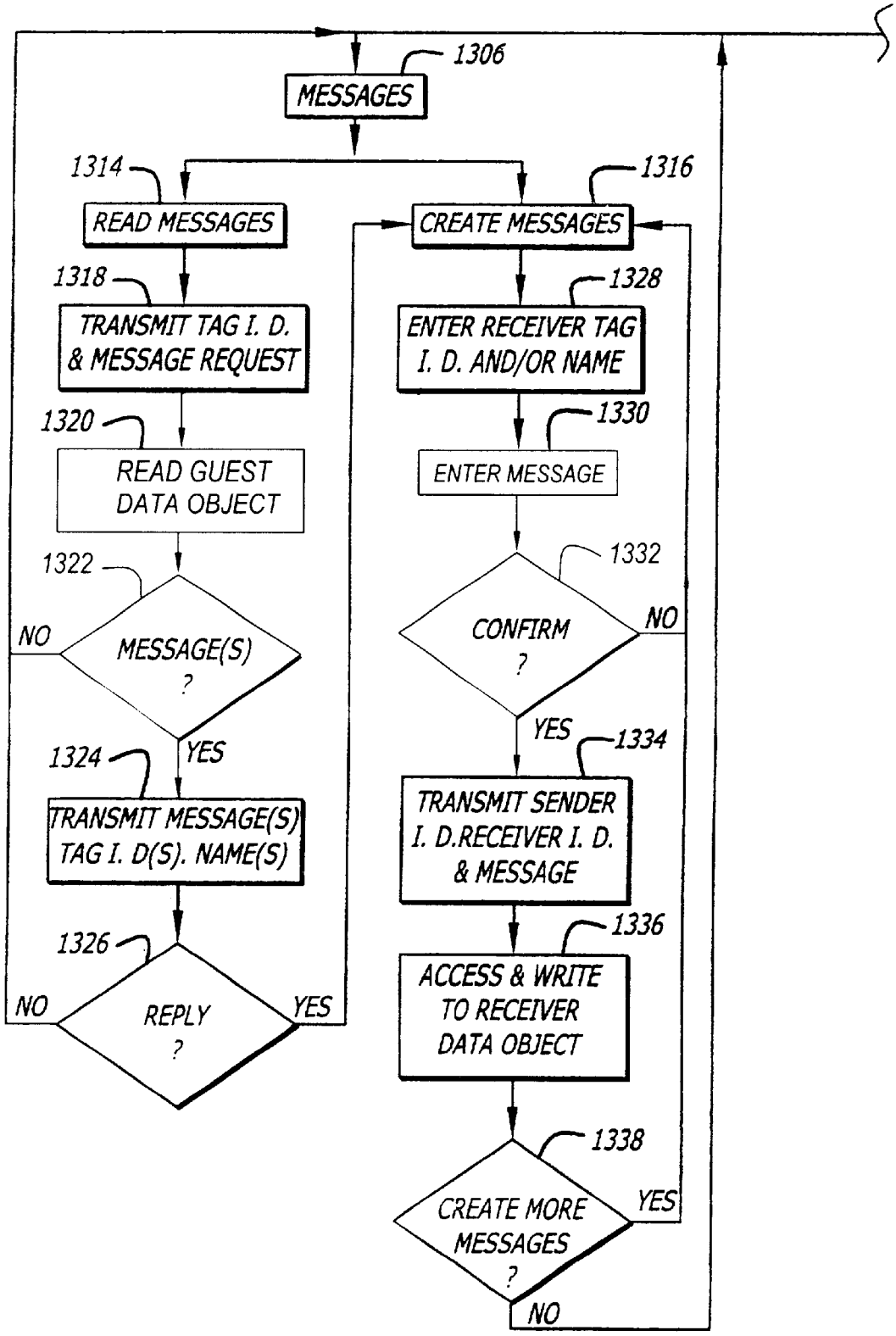
FIG. 13-a

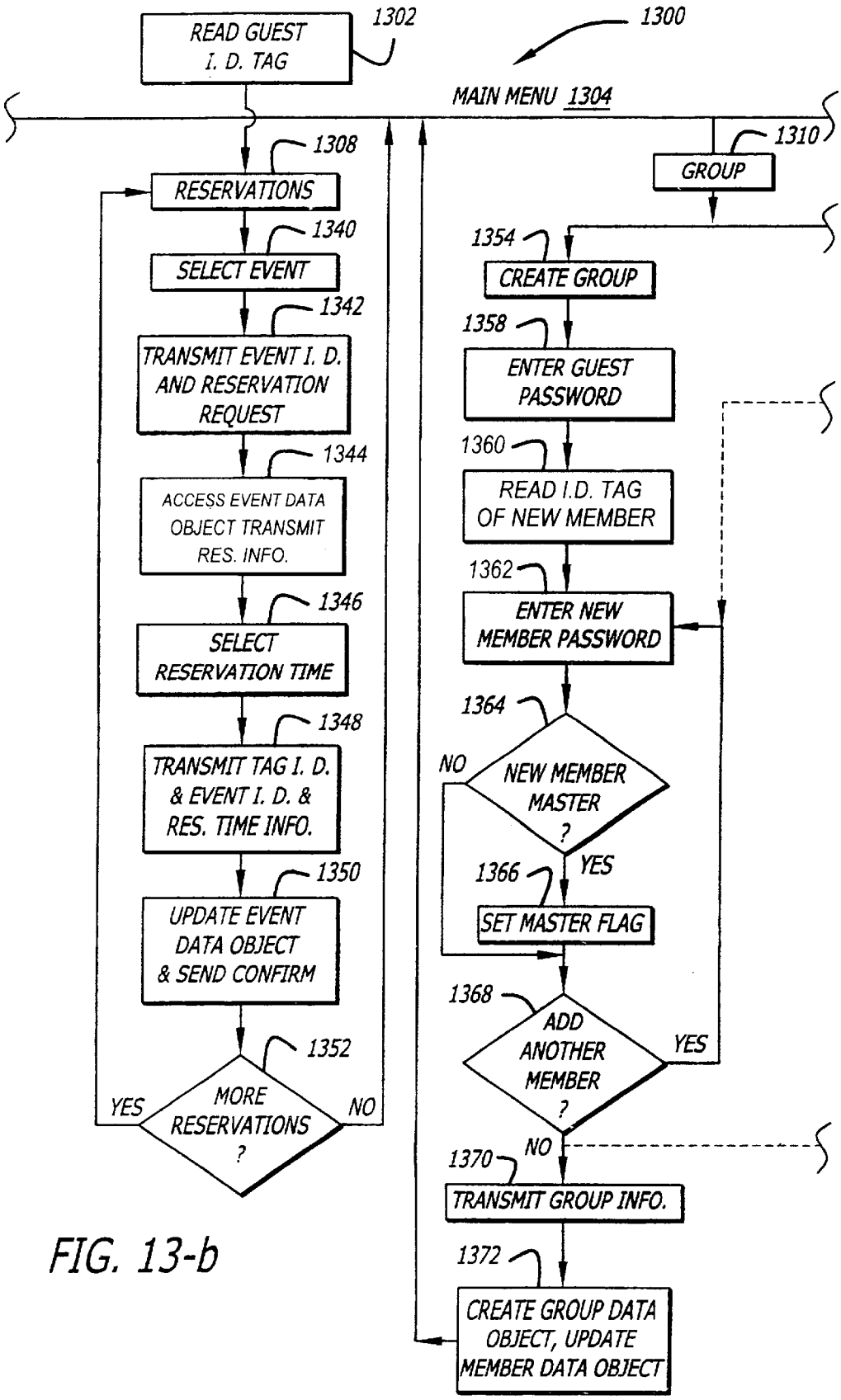
FIG. 13-b

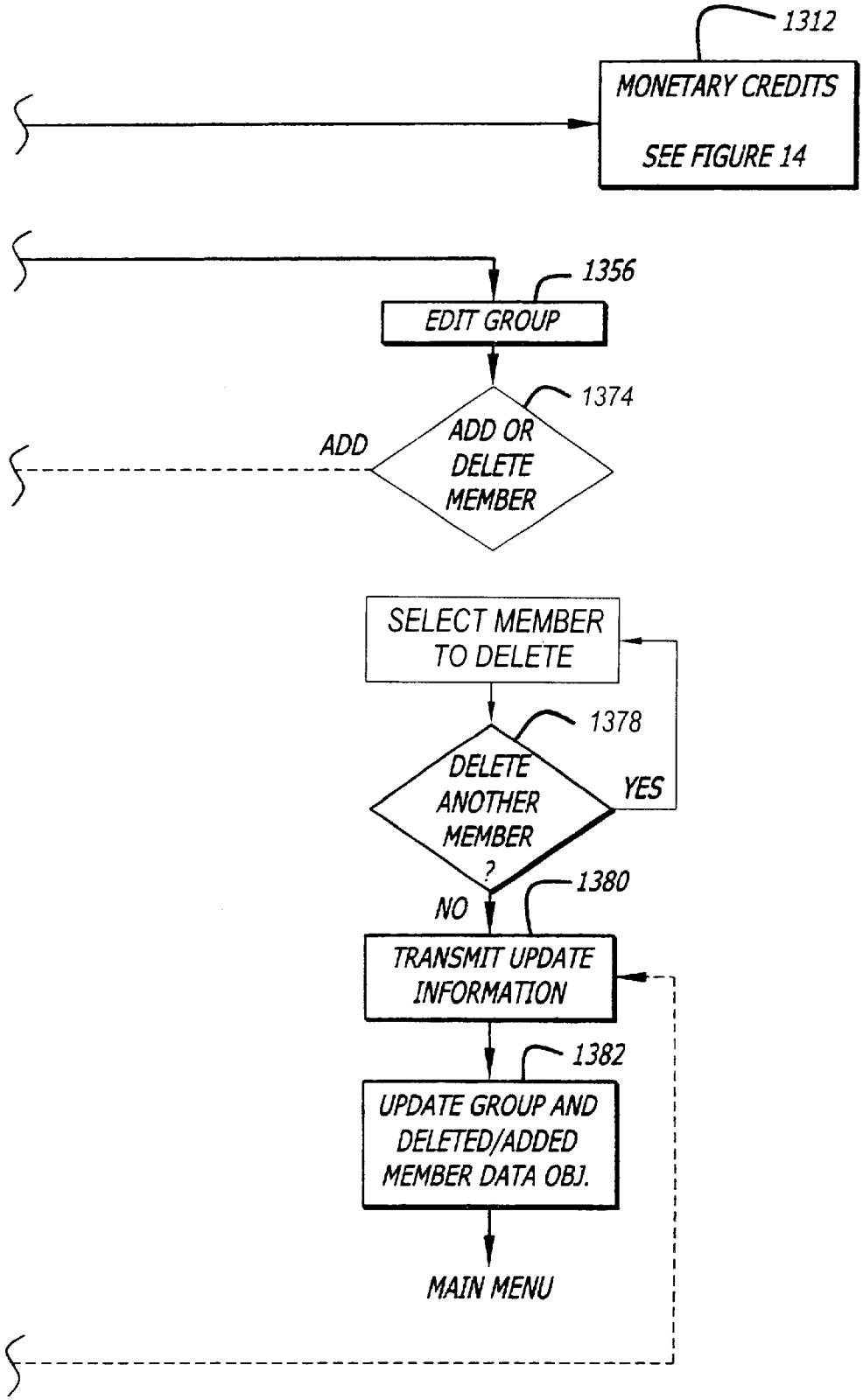
FIG. 13-c

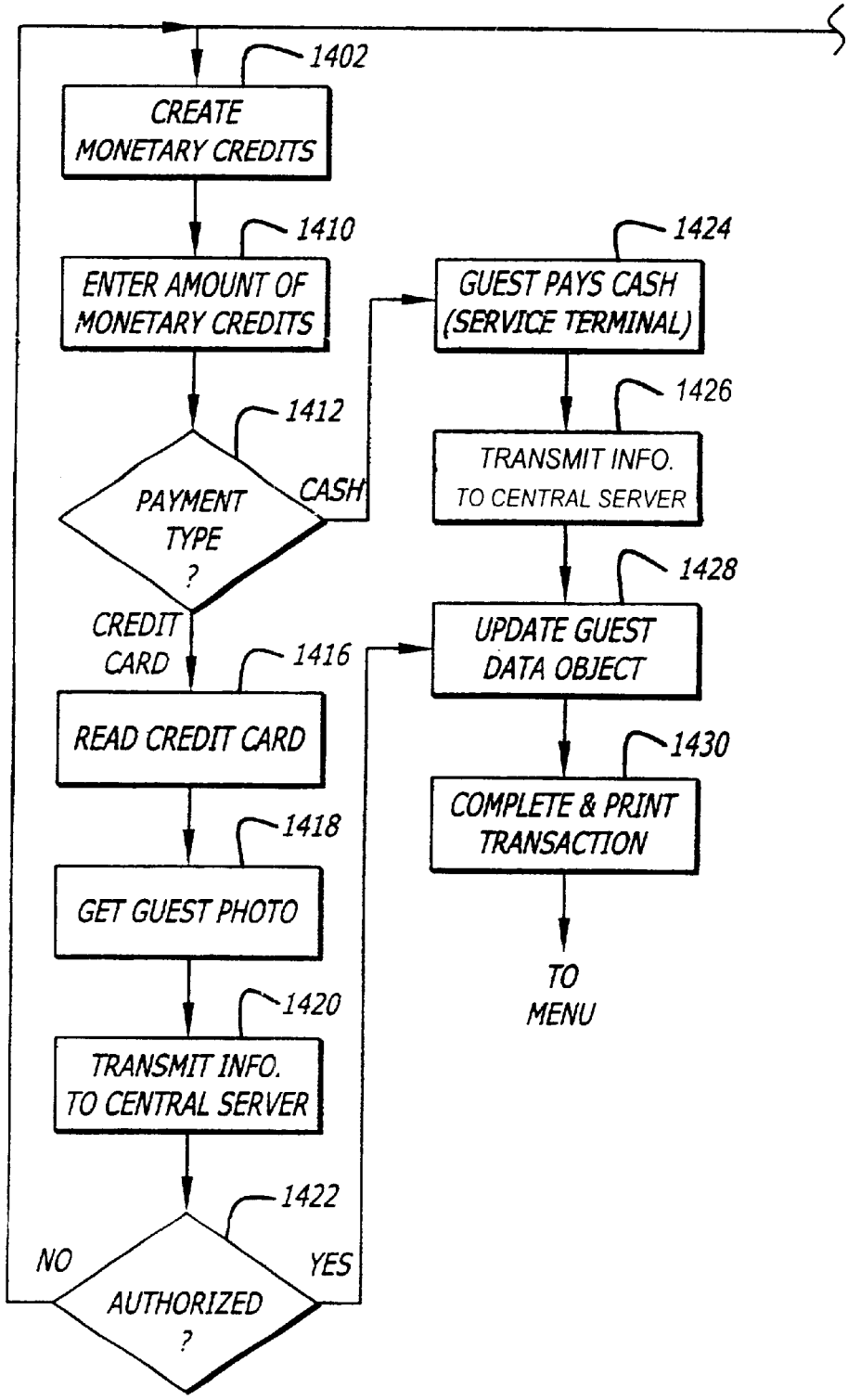
FIG. 14-a

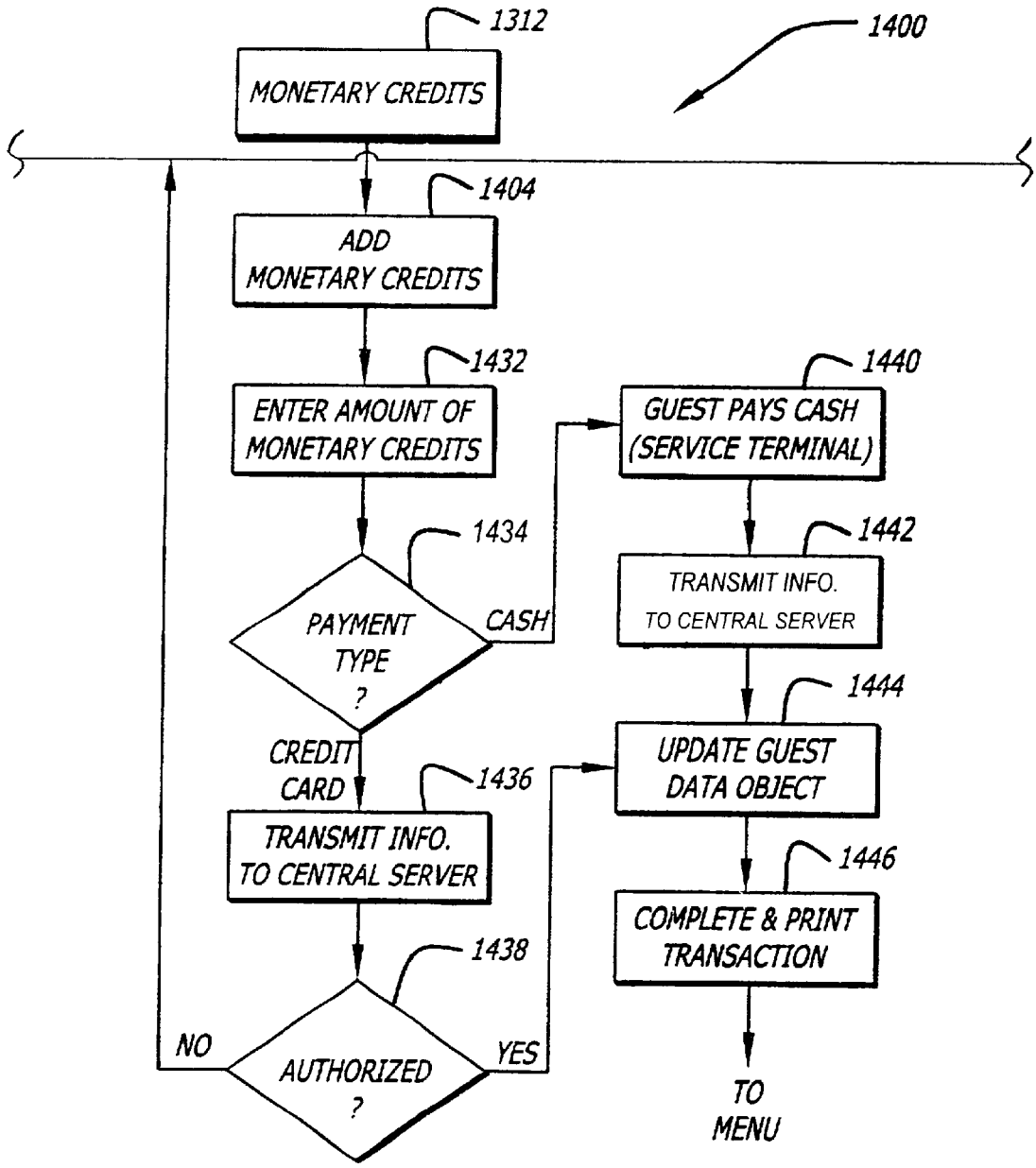
FIG. 14-b

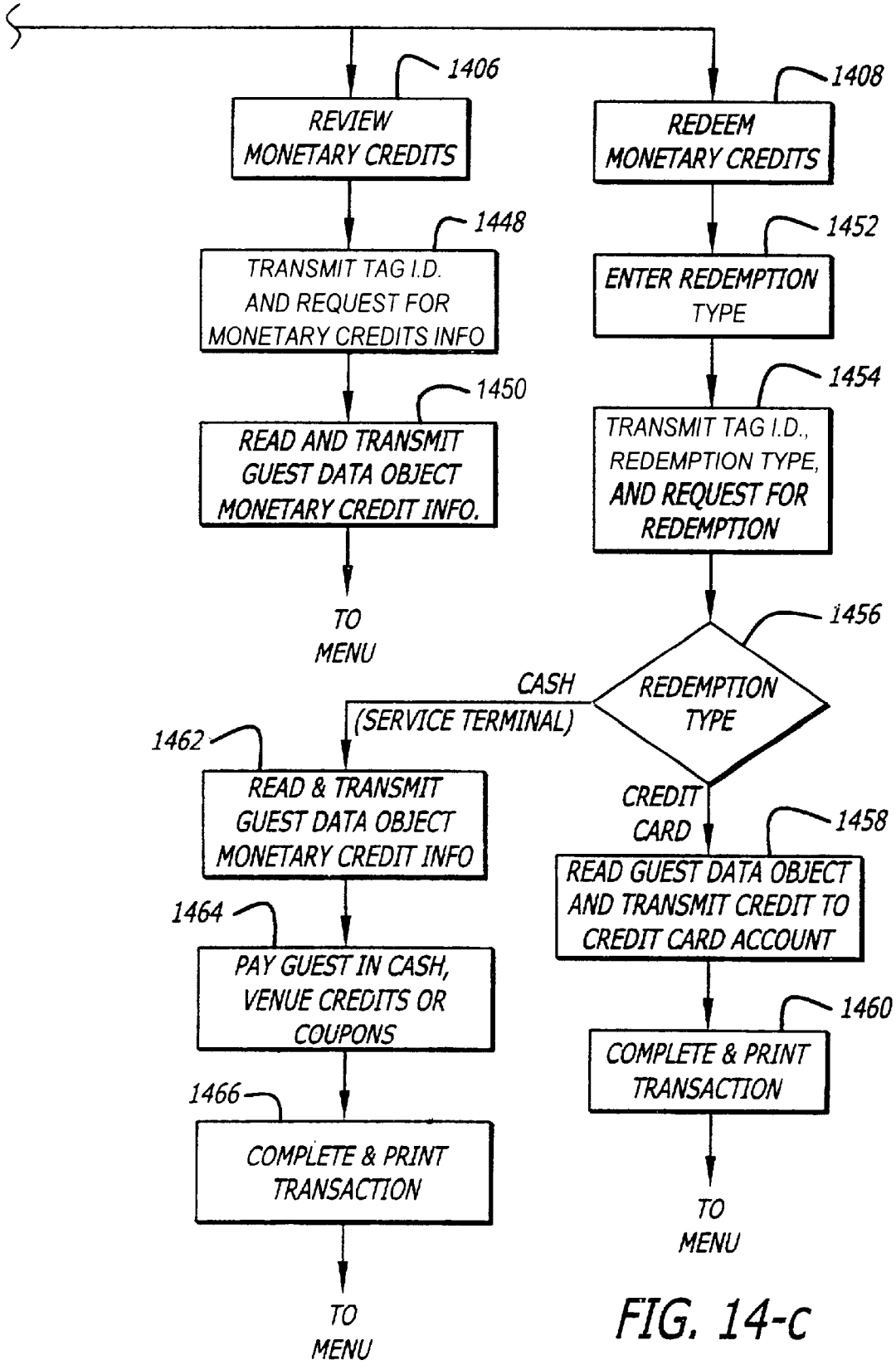
FIG. 14-c

SYSTEM AND METHOD FOR SELECTIVELY ALLOWING THE PASSAGE OF A GUEST THROUGH A REGION WITHIN A COVERAGE AREA

CROSS-REFERENCE TO A RELATED APPLICATION

This patent application claims the benefit of the filing date of Provisional Patent Application, Ser. No. 60/236,576, filed on Sep. 29, 2000, entitled "Apparatus and Methods for Interactive Automated Tracking, Data Collection, and Management System," which is incorporated herein by reference.

FIELD OF THE INVENTION

The invention relates to an interactive, automated tracking, data collection, point of sale, and management system useful for coverage areas having large number of guests.

BACKGROUND OF THE INVENTION

Amusement parks have been extremely popular ever since their inception. Their immense popularity results in many thousands of people visiting a single amusement park on a daily basis. Because of the relatively large population in an amusement park on a daily basis, this creates a multitude of logistic problems.

For instance, long lines to attraction rides, gift shops and restaurants are a daily occurrence at amusement parks. Also, because of the large number of people at amusement parks, children can get lost, leave the park unattended, or leave with an unauthorized person. Additionally, the large number of people makes it difficult for separate parties to "hook up" at a particular time and location. Furthermore, because of the numerous attraction rides, gift shops, and restaurants needed to accommodate the thousands of daily guests at the park, the number of monetary transactions for rides, gifts and food is tremendously time consuming, and is a primary factor in the cause of long lines at amusement parks. Moreover, because of the large number of guests, their statistics and demographics vary substantially, and consequently make it difficult asses the statistical and demographic make-up of the guests for the purpose of marketing products and services.

Thus, there is a need for a system and method which can reduce the long lines and delays in amusement parks. There is also a need for a system and method which makes it easier to locate lost children, and prevent them from leaving the park unattended or with an unauthorized person. There is a further need for a system and method which makes it easier for separate parties to "hook up" at a later time, or leave messages for each other which can be easily accessed. Also, there is a need to facilitate monetary transactions within amusement parks. Additionally, there is a need for a system and method which makes it easier to obtain, organize, and process statistical and demographic information of guests at an amusement park which can be used for marketing purpose.

The above system and method and others are provided herein in accordance with the invention.

BRIEF DESCRIPTION OF THE DRAWINGS

FIG. 8 illustrates a table of data fields of an exemplary guest data object in accordance with the invention;

FIG. 9 illustrates a table of data fields of an exemplary group data object in accordance with the invention;

FIG. 10 illustrates a table of data field of an exemplary event data object in accordance with the invention;

FIG. 13 illustrates a flow diagram of an exemplary operations process of a kiosk system in accordance with the invention;

FIG. 14 illustrates a flow diagram of an exemplary monetary credits process at a kiosk system or in-park system terminal in accordance with the invention.

DETAILED DESCRIPTION OF THE INVENTION

I. Overview

The invention described herein relates to a network computer system for automatically performing various functions within a coverage area having many guests at a given time. The coverage area may include amusement parks, ski resorts, movie and live theaters, cruise ships, the Olympics, concerts, county fairs, casinos, hotels, etc. Some of the various functions performed by the network computer system of the invention include obtaining and organizing statistical, demographic, and purchasing information of the guests for generating market reports and analysis useful for marketing, advertising and product/service development purposes. The network computer system of the invention can also protect children by providing a means for locating lost children and preventing children from exiting the coverage area unattended or with an unauthorized person. The network computer system of the invention can also provide a means for guests to leave messages for other persons and establishments within the coverage area. The network computer system of the invention in addition allows guests to reserve times for attraction rides, restaurants, and other events, and essentially schedule their daily activities at the coverage area. The network computer system of the invention also facilitates the making of transactions within the coverage area to reduce delays. Other aspects of the network computer system of the invention will become apparent in view of the following detailed description of the invention.

II. Overall Network Computer System

Figure 1:
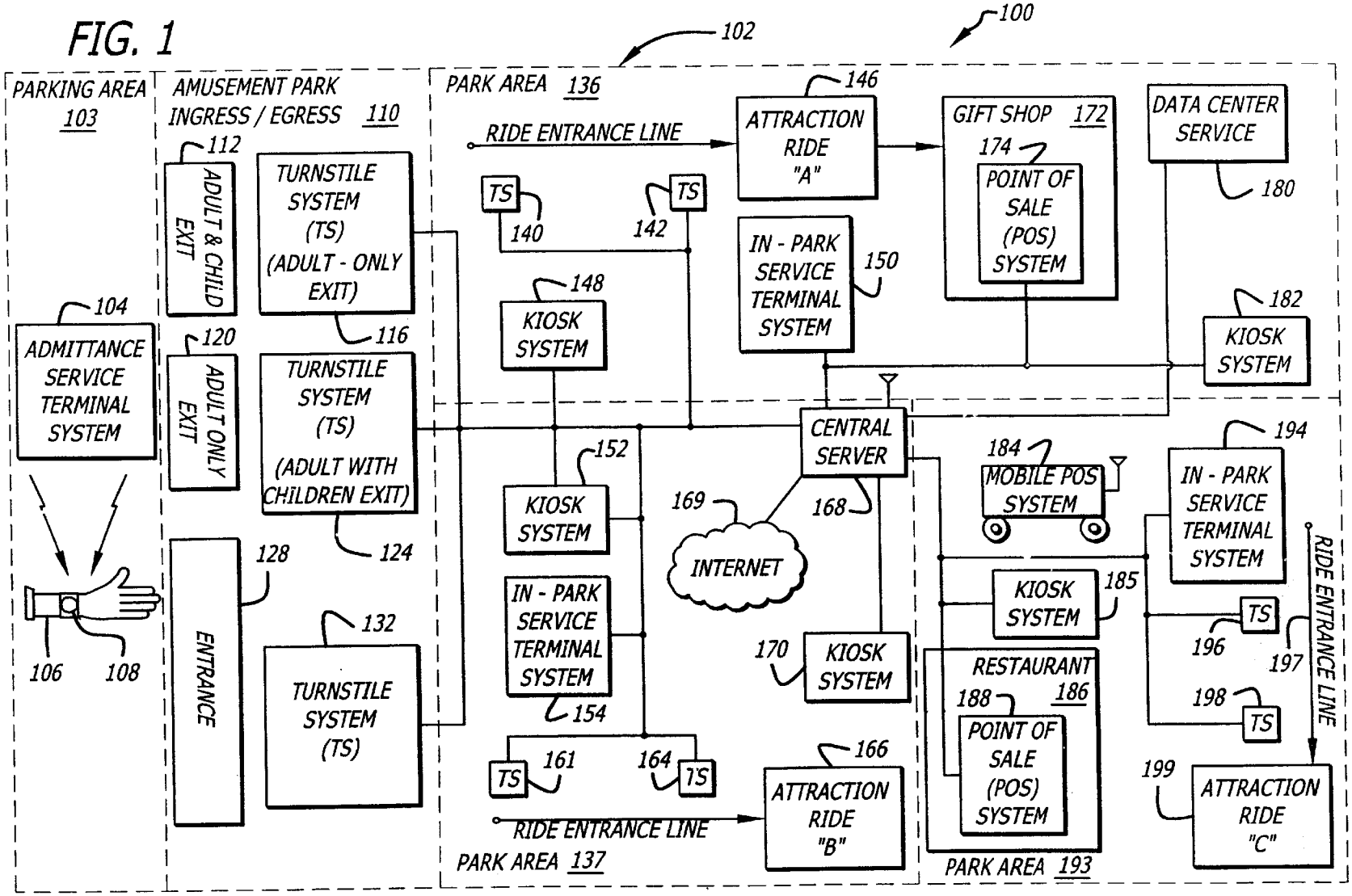
FIG. 1 illustrates a block diagram of a network computer system useful for performing various logistic and control functions in a coverage area in accordance with the invention.

FIG. 1 illustrates a block diagram of a network computer system 100 useful for performing the various logistic and control functions in a coverage area 102 in accordance with the invention. For the purpose of the invention, the coverage area 102 may include one or more associated establishments where a large number of people attend on a daily basis. Examples of coverage areas 102 include, but are not limited to, amusement parks, fairs, ski resorts, hotels, resorts, casinos, movie and live theaters, the Olympics, cruise ships and concerts, to name a few. For illustrative purposes, the exemplary coverage area 102 may be configured in a typical amusement park setting. Accordingly, the coverage area 102 comprises a parking lot area 103, an ingress/egress area 110, and different theme park areas 136, 137 and 193. The boundaries of these various areas are shown in FIG. 1 as dashed lines.

As previously discussed, the various functions performed by the network computer system 100 include providing an easy, economical and practical means for finding lost children and preventing unauthorized leave or taken of children; providing an easy, economical and practical means for separate parties or people to leave and access messages for and from each other; providing an easy, economical and practical means for facilitating monetary transactions at the coverage area; providing a easy, economical and practical means for reserving times for attraction rides, restaurants, and other events; and providing an easy, economical and practical means of obtaining statistical, demographic and purchasing information for marketing purposes. These functions are merely examples, and other functions are capable with the network computer system 100 of the invention.

More specifically, the network computer system 100 comprises a central server 168, a plurality of service terminal systems including an admittance service terminal system 104 and various in-park service terminal systems 150, 154 and 194 strategically placed at various location within the coverage area 102, and a plurality of turnstile systems 116, 124, 132, 140, 142, 161, 164, 196 and 198 typically located at the entrance 128 and exists 112 and 120 of the coverage area 102 and also at entrances to rides, attractions and other events. The network computer system 100 further comprises a plurality of kiosk systems 148, 152, 170, 182 and 185 also strategically placed at various locations within the coverage area 102. Additionally, the network computer system 100 further includes a plurality of point-of-sale (POS) systems 174 and 188 typically located at gift shops 172 and restaurants 186 including a mobile POS system 184 located in a food cart or other mobile vendors. Furthermore, the network computer system 100 may also include a data center server 180 for accumulating data and issuing marketing reports and analysis. Each of these components of the network computer system 100 are data coupled together by a hardwire link and/or wireless link, and may as well include a link to the Internet 169.

III. Components of the Network Computer System

A. Service Terminal System

As previously discussed, a plurality of service terminal systems may be strategically placed within a coverage area 102. Of these service terminal systems, there may be one or more located near the entrance 128 to the coverage area 102, such as admittance service terminal system 104. Others are located within the various park areas 136, 137 and 193 of the coverage area 102, such as in-park service terminal systems 150, 154 and 194. They are typically used by an operator of the coverage area establishment. At the admittance service terminal 104, a guest checks in, receiving a radio frequency identification (RFID) tag 108, providing statistical and demographic information to the operator, and buying monetary credits to cover the entrance fee and to buy items and services within the coverage area 102. A guest data object stored within the central server 168 is also created when the guest checks in and receives the RFID tag 108. At an in-park service terminal system, a guest can purchase monetary credits (either by cash or credit card) for monetary transactions made within the coverage area 102.

Figure 2:
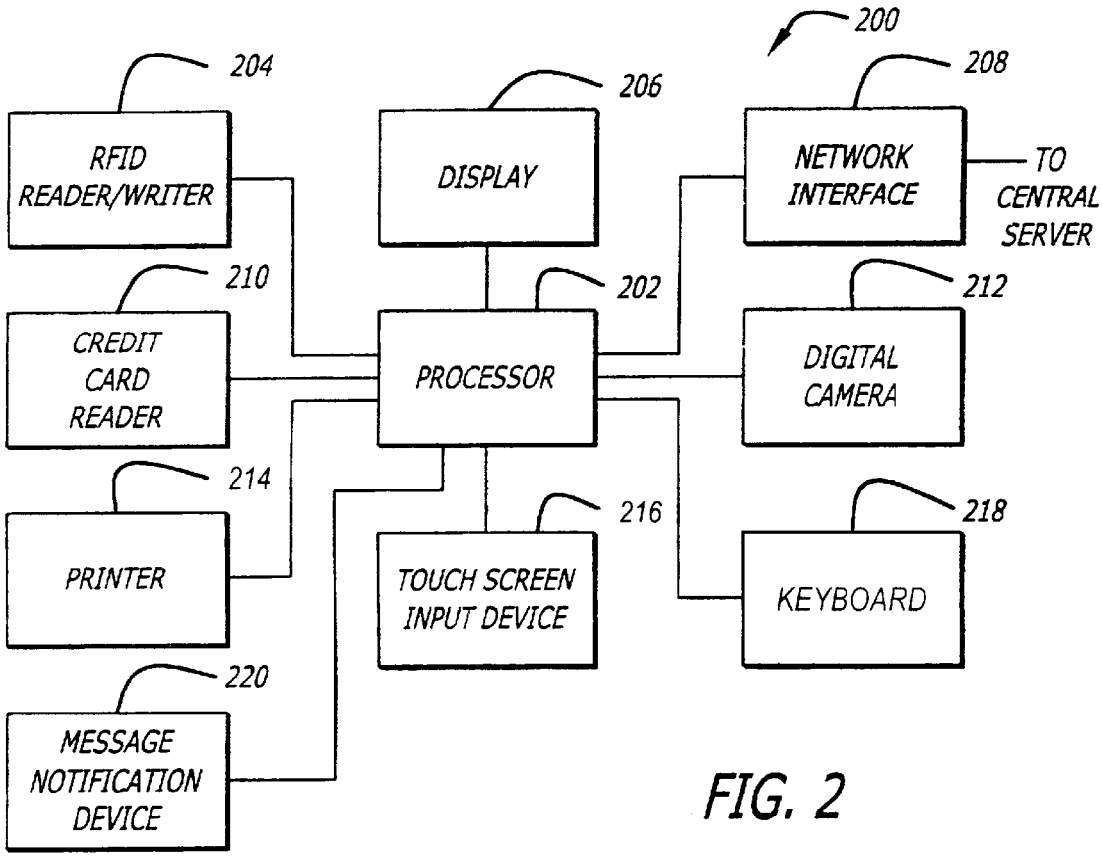
FIG. 2 illustrates a block diagram of an exemplary service terminal system in accordance with the invention.

FIG. 2 illustrates a block diagram of an exemplary service terminal system 200 in accordance with the invention. The service terminal system 200 comprises a radio frequency identification (RFID) reader/writer 204, a display 206, a network interface 208, a credit card reader 210, optionally a digital camera 212, a printer 214, an input device such as a touch screen input device 216 or a keyboard 218, and a message notification device 220. The RFID reader/writer 204 serves to read and write information from and to an RFID tag 108 worn by a guest, the display 206 serves to display information to an operator, the network interface 208 serves to communicate data to and from the central server 168, the credit card reader 210 serves to read information from a guest credit card for purchasing monetary credits, the digital camera 212 serves to take digital photographs of one or more guests associated with the presented credit card, the printer 214 serves to generate hard copies of transaction confirmations, the touch screen 216 and/or keyboard 218 allows an operator to enter information into the system 200. These components of the service terminal system 200 perform their function under the control of a processor 202.

B. Turnstile System

As previously discussed, a plurality of turnstile systems may be strategically placed within a coverage area 102. For instance, some turnstile systems may be located at the entrance 128 to the coverage area 102, such as turnstile system 132, others located at the exit of the coverage area 102, such as turnstile systems 116 and 124, and others at the entrance of rides, attractions and/or other events, such as turnstile systems 140, 142, 161, 164, 196 and 198. A turnstile system allows a guest to pass through if the central server determines that the guest qualifies to pass through. This can be used to allow paying guests to enter the coverage area, to prevent small children from exiting the coverage area without an authorized adult, to prevent small children and people with disabilities from entering a ride, attraction or other event which can be harmful to them, and to measure the movement of guests within lines. Additionally, the turnstile system can be used to notify guests of any received messages.

Figure 3:
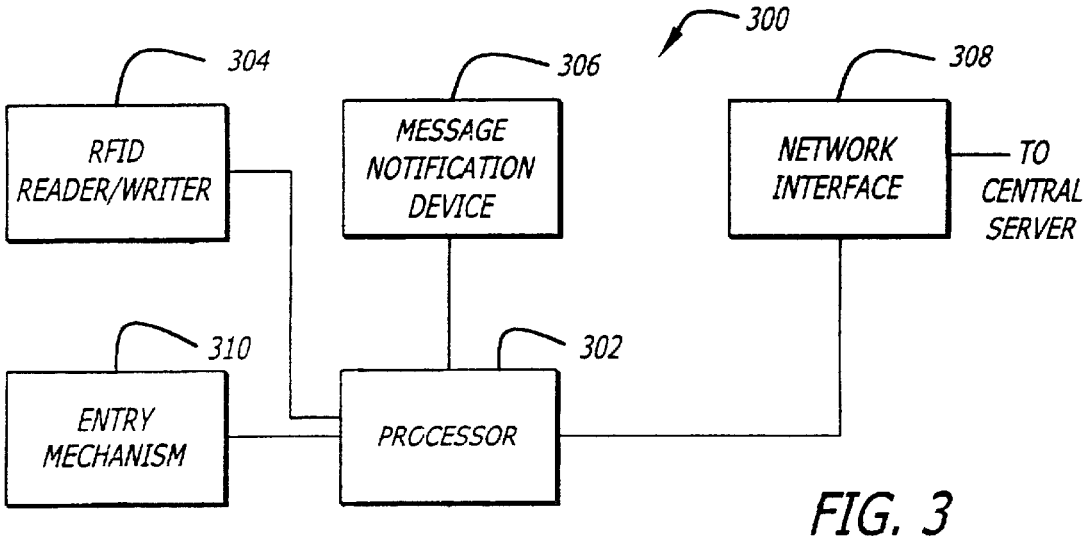
FIG. 3 illustrates a block diagram of an exemplary turnstile system in accordance with the invention.

FIG. 3 illustrates a block diagram of an exemplary turnstile system 300 in accordance with the invention. The turnstile system 300 comprises an RFID reader/writer 304, a message notification device 306, a network interface 308, and an entry mechanism 310 all coupled to a processor 302. The RFID reader/writer 304 serves to read and write information from and to an RFID tag 108 worn by a guest, the message notification device 306 serves to notify guests of received messages, the network interface 308 serves to communicate data to and from the central server 168, and the entry mechanism 310 allows a guest to pass through if a favorable signal is received from the central server 168. These components of the turnstile system 300 perform their function under the control of the processor 302.

C. Kiosk System

As previously discussed, a plurality of kiosk systems may be strategically placed within a coverage area 102, such as kiosk systems 148, 152, 170, 182 and 185. A kiosk system is used by a guest at a coverage area 102 to purchase monetary credits (by credit card) for monetary transactions made within the coverage area 102, to send messages to other guests at the coverage area 102, to establish groups of guests at the coverage area 102, and to reserve entrance times at rides, attractions, restaurants, and other events.

Figure 4:
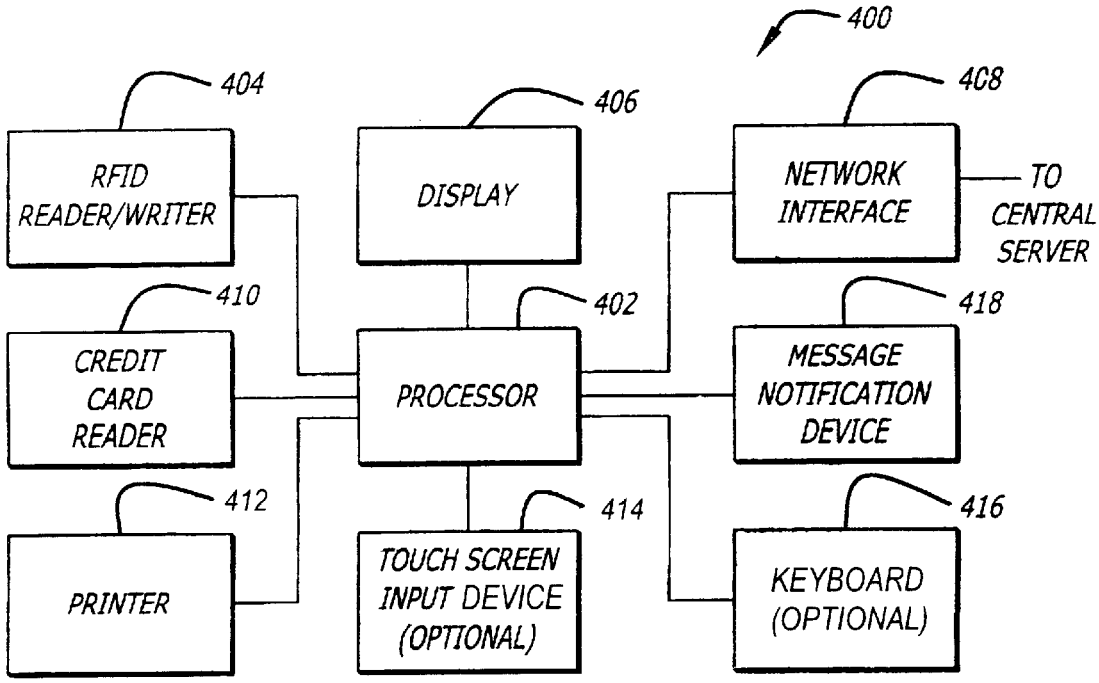
FIG. 4 illustrates a block diagram of an exemplary kiosk system in accordance with the invention.

FIG. 4 illustrates a block diagram of an exemplary kiosk system 400 in accordance with the invention. The kiosk system 400 comprises a radio frequency identification (RFID) reader/writer 404, a display 406, a network interface 408, a credit card reader 410, a printer 412, an input device such as a touch screen input device 414 and/or a keyboard 416, and a message notification device 418. The RFID reader/writer 404 serves to read and write information from and to an RFID tag 108 worn by a guest, the display 406 serves to display information to a guest, the network interface 408 serves to communicate data to and from the central server 168, the credit card reader 410 serves to read information from a guest credit card for purchasing monetary credits, the printer 412 serves to generate hard copies of receipts, messages sent or received, members of groups, and ride reservation information, the touch screen 414 and/or keyboard 416 allows a guest to enter information to the system 400. These components of the service terminal system 400 perform their function under the control of the processor 402.

D. Point-of-Sale (POS) System

As previously discussed, a plurality of point-of-sale (POS) systems may be located within various places of a coverage area, typically at gift shops, restaurants, and mobile vendors, etc., such as POS systems 174 and 188 and mobile POS system 184 at the exemplary coverage area 102. A POS system allows a guest to purchase food, souvenirs, and other items and services at the coverage area 102 without the need of using a credit card or cash. A typical purchase entails a guest selecting an item to purchase, taking the item to the POS system, reading the RFID tag of the guest, and completing the transaction by modifying the amount of monetary credit previously purchased by the guest. This process substantially speeds up monetary transactions within the coverage area 102, reducing the large lines at purchasing counters.

Figure 5:
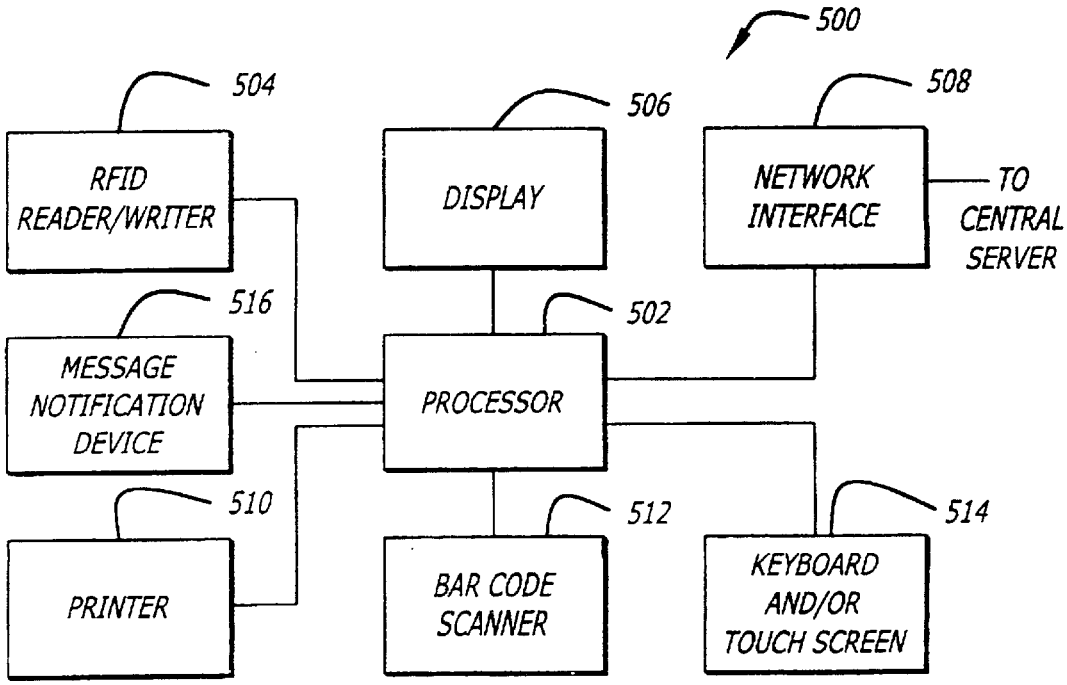
FIG. 5 illustrates a block diagram of an exemplary POS system in accordance with the invention.

FIG. 5 illustrates a block diagram of an exemplary POS system 500 in accordance with the invention. The POS system 500 comprises an RFID reader/writer 504, a display 506, a network interface 508, a printer 510, a bar code scanner 512, and an input device such as a keyboard and/or touch screen 514. The RFID reader/writer 504 serves to read and write information from and to an RFID tag 108 worn by a guest, the display 506 serves to display information to a cashier and/or guest, the network interface 508 serves to communicate data to and from the central server 168, the printer 510 serves to generate hard copies of receipts (folios), the bar code scanner 512 serves to read bar codes from purchasing items, and the keyboard 514 allows an operator to enter information to the system 500. These components of the POS system 500 perform their functions under the control of the processor 502.

E. Central Server

As previously discussed, the network system 100 of the invention includes a central server 168 which performs the logistics and control functions for the network. With regard to logistics, the central server creates a guest data object for each guest at the coverage area. As will be discussed in more detail, the data object may include the guest's name, guest identifier, statistical and demographic information relating to the guest, a digital photograph of the guest, the identification number of the authorized adult if the guest is a child, restrictions information such as disabilities, health conditions, and special access, credit card information of the guest, available monetary credits, group identifier, received messages, purchase and event attendance information, last recorded location, and password. Additionally, the central server can create a group data object to identify guests that belong to a group including those who are designated as primary members of a group. Furthermore, the central server also manages events through an event data object.

With regard to control, the central server sends data and control signals to the various components of the system, such as the service terminal systems, the turnstile systems, the kiosk systems, and the POS systems, so that they can perform their intended operations. For instance, at the admittance service terminal 104 when a guest checks in and purchases sufficient monetary credits to cover the coverage area entrance fee, the central server creates a data object for the guest including the amount of monetary credits purchased or pre-authorized. When the guest attempts to enter the coverage area 102 by having the guest's RFID tag 108 read by the entrance turnstile system 132, the central server 168 modifies the amount of monetary credits in the guest's data object by the entrance fee, and then sends a control signal to the turnstile system 132 to activate its entry mechanism. More details of the functions performed by the central server is explained below in the Applications Section.

Figure 6:
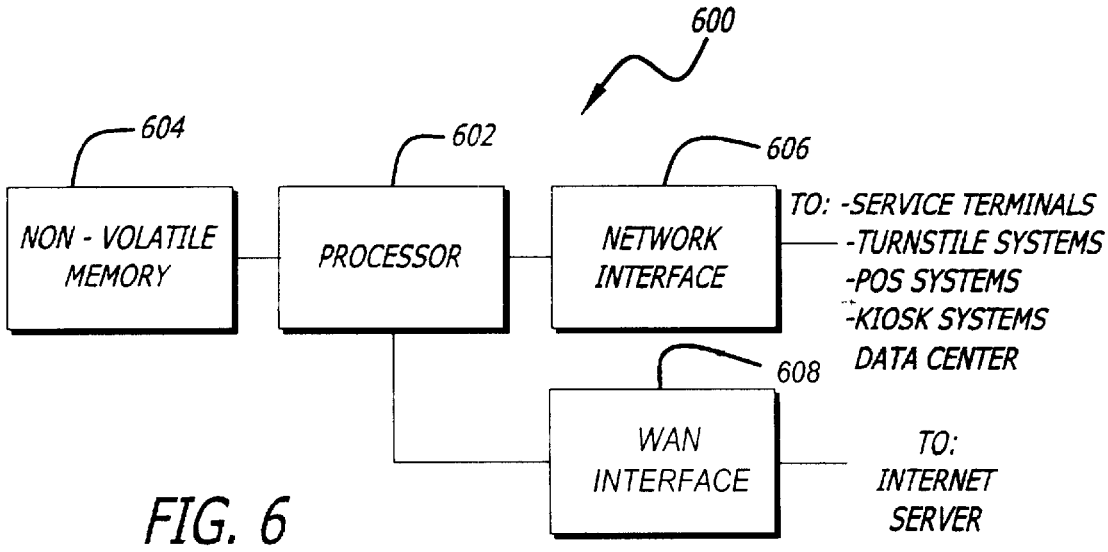
FIG. 6 illustrates a block diagram of an exemplary central server in accordance with the invention.

FIG. 6 illustrates a block diagram of an exemplary central server 600 in accordance with the invention. The central server 600 comprises a non-volatile memory 604, a network interface 606, and a wide area network (WAN) interface 608 all communicatively coupled to a processor 602. The non-volatile memory 604 serves to store the guest data structure and objects, the group data structure and objects, the event data structure and objects, the software programs for performing the logistics and control functions of the central server 600, and web documents (e.g. HTML and flash files) that can be accessed by outsiders by way of a wide area network (e.g. the Internet). Examples of non-volatile memory include, but are not limited to, magnetic storage mediums such as hard disks, redundant array of inexpensive hard disks (RAID) and other formats, optical storage mediums such as rewritable digital versatile discs (DVDs), compact disc (CDs), and other formats, semiconductor storage mediums, such as flash memory, electrically erasable programmable read only memories (EEPROMS) and other formats. The network interface 606 serves to communicate with the service terminal systems, the turnstile systems, the POS systems, the kiosk systems, and the data center. The WAN interface 608 serves to communicate with users at external computer systems by way of a wide area network such as the Internet.

F. Data Center Server

As previously discussed, the network system 100 of the invention includes a data center server 180 for accumulating data and issuing marketing reports and analysis. Periodically or when requested, the central server 162 transmits at least some of the information in the guest data objects it has created to the data center server 180. Since guest data objects include statistical and demographic information about the guest and purchases and event attendance throughout a day, the data center server 180 can use this information to generate marketing reports and analysis. This gives valuable information to the coverage area establishment as to the overall purchase and event desires of the guests of the coverage area, and allows the establishment to better tailor their products, services, and events to suit the desires of their guests.

Figure 7:
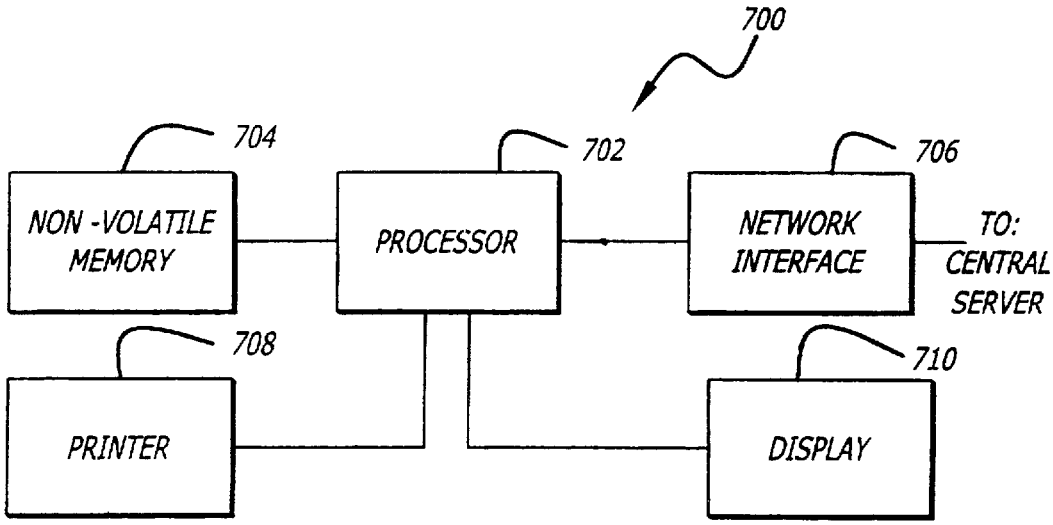
FIG. 7 illustrates a block diagram of an exemplary data center server in accordance with the invention.

FIG. 7 illustrates a block diagram of an exemplary data center server 700 in accordance with the invention. The data center server 700 comprises a nonvolatile memory 704, a network interface 706, a printer 708 and a display 710, all coupled to a processor 702. The non-volatile memory 704 serves to store the guest data object information and software programs for retrieving data from the central server and generating marketing analysis and reports. Examples of non-volatile memory include, but are not limited to, magnetic storage mediums such as hard disks, redundant array of inexpensive hard disks (RAID) and other formats, optical storage mediums such as rewritable digital versatile discs (DVDs), compact disc (CDs), and other formats, semiconductor storage mediums, such as flash memory, electrically erasable programmable read only memories (EEPROMS) and other formats. The network interface 706 communicates with the central server 168 of the network system 100, the printer 708 serves to print marketing reports and analysis, and the display 710 serves to display marketing reporting and analysis information.

G. Guest Data Object

FIG. 8 illustrates a table of data fields of an exemplary guest data object 800 in accordance with the invention. As previously discussed, each time a guest checks in at the admittance service terminal system 104 and purchases sufficient monetary credits to cover the entrance fee of the coverage area 102, the central server 168 creates a guest data object 800 and stores it in the non-volatile memory 604. Each guest data object 800 contains information concerning the guest and the guest's activities within the coverage area 102.

An exemplary guest data object 800 comprises a data field 802 containing information related to a guest's RFID tag identifier, a data field 804 containing information related to the guest's name, a data field 806 containing information related to the guest's statistical (e.g. gender, age, height, weight, etc.) and demographic (e.g. residence address, national origin, race, ethnicity, etc.) information, a data field 808 containing information related to a digital photograph of the guest, a data field 810 containing information related to one or more RFID tag identifiers of authorized guest-adults if the guest is a child, a data field 812 containing information related to restrictions, disabilities, health conditions, and special access of the guest, a data field 814 containing information related to the guest's credit and/or debit card, a data field 816 containing information related to the guest's or group's monetary credits, a field 820 containing information related to a group identifier, a data field 822 containing information related to one or more received messages, a data field 824 containing information related to purchases and event attendance, a data field 826 containing information related to the last recorded location of the guest, and a data field 828 containing information related to a password. Other fields containing different information related to the guest can also be included in the guest data object 800. Some or all of the data fields of the guest data object may be stored in the identification tag 108 or the guest.

H. Group Data Object

FIG. 9 illustrates a table of data fields of an exemplary group data object 900 in accordance with the invention. As previously discussed, a guest can set up a group made up of a plurality of guests. For instance, a group can be set up consisting of family members, relatives and/or friends. Other groups can be set up consisting of school student group members, tour group members, employees at a company function, organization members, etc. Each time a group is set up, the central server 168 creates a group data object 900 and stores it in the non-volatile memory 604. Each group data object 900 contains information concerning the group members and group parameters.

An exemplary guest data object 900 comprises a data field 902 containing information related to the group identifier, a data field 904 containing information related to one or more RFID tag identifiers of one or more group members that are designated as masters of the group, a data field 906 containing information related to one or more RFID tag identifiers of one or more group members that are designated as non-masters of the group, and a data field 908 containing information related to the available monetary credits for the group. A guest that is designated as a master of a group is allowed to modify the group information stored in the guest data object 900, such as the group available monetary credits. Non-masters are not allowed to directly modify the guest data object 900. A master may also purchase a group monetary credits for use by the entire membership of the group. Thus, when a member of the group purchases an item, the cost of the item is deducted from the group available monetary credits. The group data object may contain other fields having information related to the group.

I. Event Data Object

FIG. 10 illustrates a table of data fields of an exemplary event data object 1000 in accordance with the invention. For the purpose of this patent application, an event includes rides, attractions, dining at a restaurant, and other events offered at the coverage area 102. As previously discussed, a guest can reserve times for events and also check the wait times associated with an event. For instance, the network system 100 of the invention allows a guest or group member to reserve a time to go on a particular ride, or see a particular attraction, or dine at a particular restaurant within the coverage area 102. The central server 168 can also determine and inform guests at the coverage area 102 of the wait times for the events. In this regard, an event data object is created for each event in the coverage area 102 and the central server 168 updates the information to reflect current available times and wait times.

An exemplary event data object 1000 comprises a data field 1002 containing information related to the event identifier, a data field 1004 containing information related to the average wait time for the event, a data field 1006 containing information related to available reservation times for the event, a data field 1008 containing information related to group or guest identifiers that have reservations for the event and their corresponding reservation times, a data field 1010 containing information related to the current capacity, and a data field 1012 containing information related to the maximum capacity of the event. The event data object may contain other fields with information related to the event.

IV. Applications

A. Obtaining an Identification Tag—Creating a Guest Data Object

Figure 11:
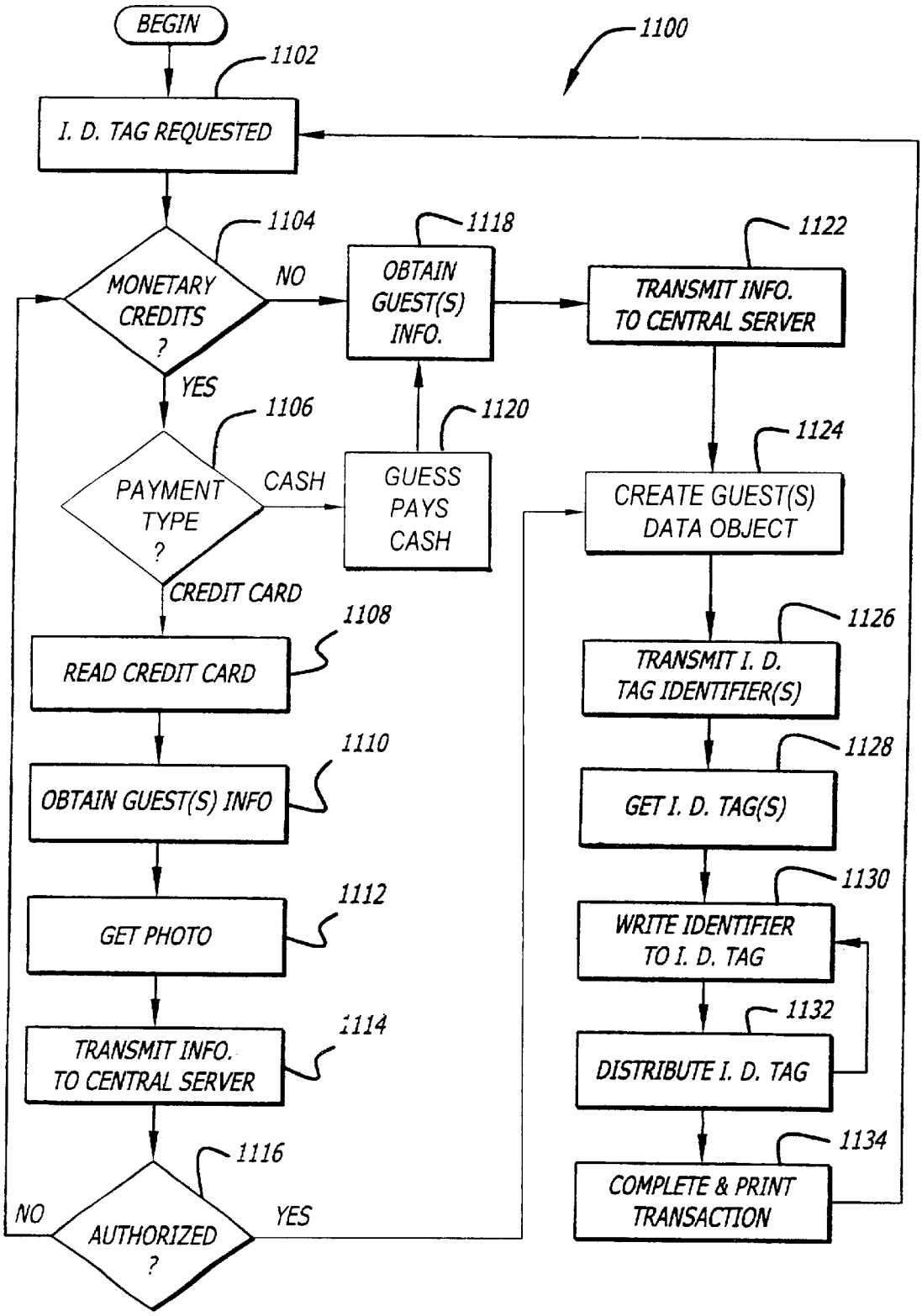
FIG. 11 illustrates a flow diagram of an exemplary operations process at an admittance service terminal in accordance with the invention.

FIG. 11 illustrates a flow diagram of an exemplary admittance process 1100 at the admittance service terminal 104 at the entrance to the coverage area 102. In step 1102, a guest requests one or more identification tags 108 for respectively the guest and other members of the guest's group. In the exemplary embodiment, the identification tag 108 is configured into a radio frequency identification (RFID) tag having a memory for storing information related to the identification of the tag which can be electronically read and/or written to by read/write (R/W) heads. The identification tag 108 can be configured into many formats to be worn by guests, such as a bracelet, wrist band or attachment pin. In step 1104, an operator at the admittance service terminal 104 asks the guest if monetary credits are desired for the entrance fee into the coverage area 102 and other monetary transactions within the coverage area 102.

If the guest desires to purchase monetary credits, in step 1106 the operator at the admittance service terminal 104 asks the guest for the payment type (e.g. credit card or cash). If the payment type is credit or debit card, in step 1108 the service terminal processor 202 causes the information on the credit card to be read by the credit card reader 210. In step 1110, the operator at the admittance service terminal 104 obtains statistical and/or demographic information of the guest and members of the guest's group. This information is entered into the admittance service terminal 104 by the operator with the use of the touch screen input device 216 or keyboard 218. In step 1112, a photograph of the guest having the credit card may be taken by the digital camera 212 for later verification in the coverage area 102 during transactions. In step 1114, the service terminal processor 202 causes the transmission of the credit card information, guest statistical and demographic information, and guest photograph to the central server 168 by way of the network interface 208.

After the central server 168 (600) receives this information, in step 1116 the central server processor 602 processes the credit card information to determine if the guest is authorized to purchase the amount of monetary credits requested. If the central server processor 602 determines that the guest is not authorized for the amount of monetary credits requested, the admittance process then returns to step 1104 to give the guest another opportunity to use another credit card, pay cash, or waive the monetary credits. If in step 1116 the central server processor 602 determines that the guest is authorized for the amount of monetary credits requested, in step 1124 the central server processor 602 creates a guest data object 800 for each guest in the group and stores it in the non-volatile memory 604. In step 1126, the central server processor 602 transmits the identification tag identifier for each of the guest in the group to the admittance service terminal 104 by way of the network interface 606.

In step 1128, the operator at the admittance service terminal 104 obtains an identification tag 108 for each of the guest in the group. In step 1130, the operator causes the service terminal processor 202 to write the tag identifier to the identification tag 108 with the use of the RFID reader/writer 204. In step 1132, the written-to identification tag is distributed to the corresponding guest. Steps 1130 and 1132 are repeated until all the identification tags for the members of the group have been written to and distributed. In step 1134, the transaction is complete and a guest confirmation copy is printed with the use of the printer 214. After completion of the transaction, the admittance process 1102 returns to step 1102 for repeating the admittance process for a new guest.

If in step 1106 the guest chooses the payment type as cash, in step 1120 the guest pays cash to the operator at the admittance service terminal 104. Then in step 1118, the operator at the admittance service terminal 104 obtains statistical and/or demographic information of the guest and members of the guest's group. This information is entered into the admittance service terminal 104 by the operator with the use of the touch screen input device 216 or keyboard 218. In step 1122, the service terminal processor 202 causes the transmission of the payment of cash information and the guest statistical and demographic information to the central server 168 by way of the network interface 208. The admittance process 1100 then proceeds to steps 1124–1134 as previously discussed. If in step 1104 the guest would rather not use monetary credit but pay with cash or credit card within the coverage area, the admittance process 1100 proceeds to steps 1118–1134 as previously discussed.

B. Turnstile Operations—Entering and Exiting the Coverage Area and Events

Figure 12:
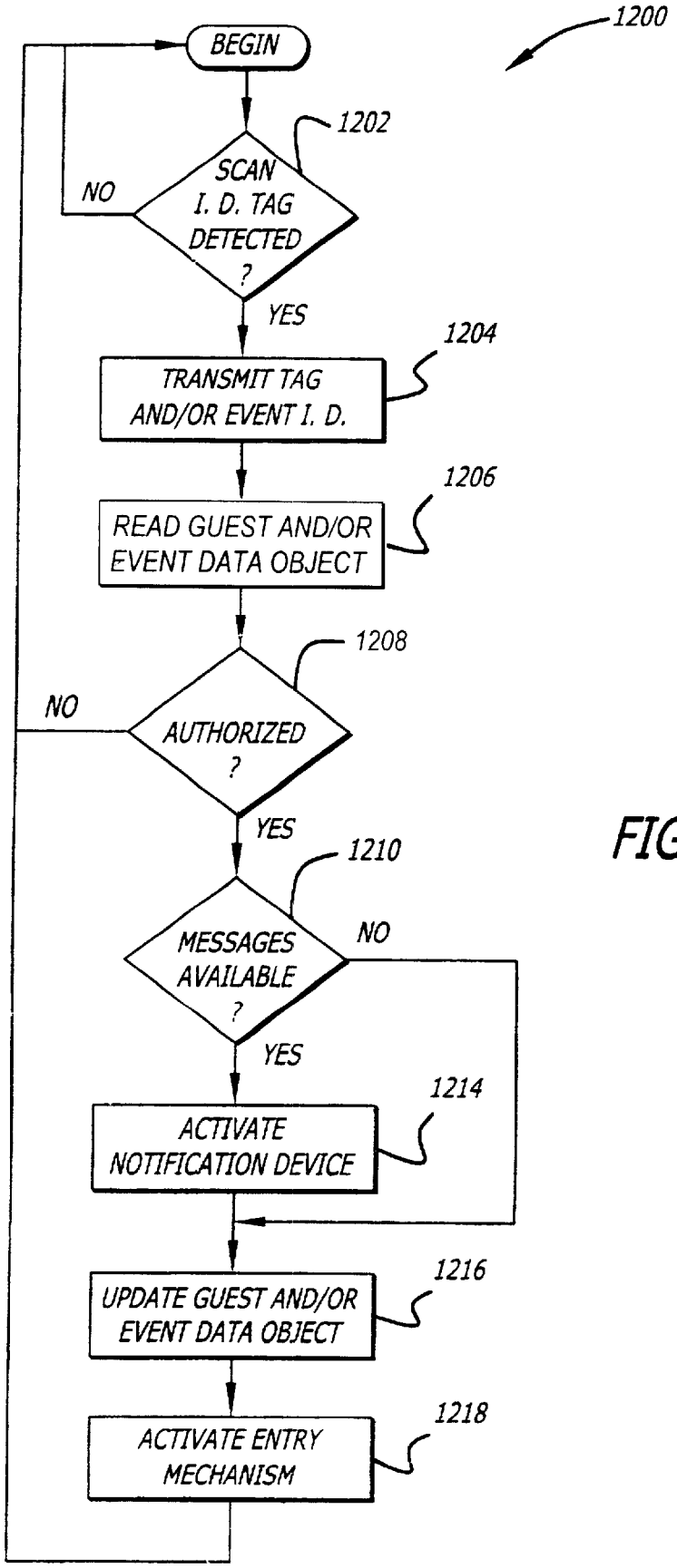
FIG. 12 illustrates a flow diagram of an exemplary operations process at a turnstile system in accordance with the invention.

FIG. 12 illustrates a flow diagram of an exemplary operations process 1200 of a turnstile system in accordance with the invention. The operations process 1200 of the turnstile system can be used for entering and exiting the coverage area. Also, the operations process 1200 can also be used for entering into rides, attractions and other events within the coverage area 102. In addition, the operations process 1200 can be used to prevent children from exiting the coverage area unattended or with an unauthorized person. Furthermore, the operations process 1200 may be used to calculate the wait times for rides, attractions, restaurants and other events within the coverage area 102.

The turnstile operations process 1200 begins at step 1202 where the RFID reader/writer 304 of the turnstile system 300 is continuously scanning until a guest identification tag 108 is detected. If a guest identification tag 108 is detected, in step 1204 the tag identifier is read by the RFID reader/writer 304 and transmitted by the processor 302 to the central server 168 by way of the network interface 308. After receiving the tag identifier, in step 1206 the central server processor 602 accesses the guest data object associated with the tag identifier from the non-volatile memory 604. In step 1208, the central server processor 602 determines if the guest is authorized to pass through, which depends on the application being used for the turnstile system.

If the turnstile system 300 is used at the entrance 128 to the coverage area 102, the central server processor 602 reads the available monetary credits field 816 of the guest data object 800 to determine if there is sufficient monetary credits to cover the entrance fee of the coverage area 102. If there is insufficient monetary credits, the central server processor 602 sends a signal back to the turnstile system indicating insufficient funds or times-out. In either case, the turnstile process 1200 returns to the beginning. If there is sufficient monetary credits, the turnstile process 1200 proceeds.

If the turnstile system is used at an adult exit 116 of the coverage area 102, the authorization step 1208 is skipped.

If the turnstile system 300 is used at an adult-with-children exit 124 and the guest exiting is a child, the authorization step 1208 may further involve the reading of the identification tag of the authorized adult. More specifically, in step 1206 the central server processor 602 reads the statistical and demographic information field 806 of the guest data object 800 and determines that the guest is a child. Then, with regard to the authorization step 1208, the central server processor 602 sends a signal to the turnstile system 300 requesting the reading of the identification tag of the authorized adult. The turnstile system processor 302 then reads the identification tag 108 of the accompanying adult with the RFID reader/writer 304 and transmits the tag identifier to the central server 168 by way of the network interface 308. The central server processor 602 compares the read tag identifier with those in the authorized adult field 810. If there is a match, then the exit authorization for the guest-child is approved. If not, the central server processor 602 notifies security to investigate the child security breach.

If the turnstile system 300 is used at an entrance to an event (e.g. a ride or attraction), the authorization step 1208 may further involve ascertaining whether the guest is qualified to participate in the event and/or requires special access. More specifically, in step 1204 the turnstile system processor 302 reads the guest identification tag is read and transmits the tag identifier along with the event identifier to the central server 168. In step 1206, the central server processor accesses the guest data object and event data object from the non-volatile memory 604. Then, with regard to the authorization step 1208, the central server processor 602 reads the statistical and/or demographic information field 806 and/or the restrictions, disabilities, health conditions and special access field 812 as well as the restriction field of the event 1014 to determine if the guest is authorized to participate in the event.

For example, if a restriction of the event is that children under 12 years old cannot participate, and the guest statistical information indicates that the guest is 10 years old, the central server processor 602 does not send the authorization signal to the turnstile system 300. If the child's age is 14, then the central server processor 602 sends the authorization signal to the turnstile system 300. Similarly, if a restriction of the event is that no children with a height of 5 feet and under can participate, and the guest statistical information indicates that the guest is 4 feet, 6 inches, the central server processor 602 does not send the authorization signal to the turnstile system 300. If the child's height is 5 feet, 3 inches, then the central server processor 602 sends the authorization signal to the turnstile system 300. Additionally, if a restriction of the event is that no person with a heart condition can participate, and the guest health condition information indicates that the guest has heart condition problems, the central server processor 602 does not send the authorization signal to the turnstile system 300. Otherwise, the central server processor 602 sends the authorization signal to the turnstile system 300.

With regard to special access, some events may have turnstile systems located that allow a guest with special access to bypass the normal entrance line to an event. In this regard, in step 1206 the central server processor 602 reads the special access field 812 of the guest data object 800. If the special access field 812 indicates special access for the guest, then in step 1208 the central server processor 602 sends the authorization signal to the turnstile system 300 to activate the entry mechanism 310. Otherwise, the central server 168 does not send the authorization signal.

After authorization has been given, in step 1210 the central server processor 602 accesses the received message field 822 of the guest data object 800 to determine whether there are one or more messages for the guest. As discussed, other guests as well as the coverage area establishments can leave messages for guests. If the central server processor 602 determines that the guest has a message, in step 1214 the central server processor 602 transmits a signal to the turnstile system 300 to activate its message notification device 306. Otherwise, the turnstile process 1200 proceeds to step 1216 of updating the guest and/or event data objects.

The central server processor 602 updates the guest and/or event data objects based on the application for the turnstile system 300. If the turnstile system 300 is at the entrance 128 to the coverage area 102, the central server processor 602 updates the available monetary credits field 816 to reflect the deduction of the entrance fee, and the last recorded location field 826 to reflect that the guest has entered the coverage area 102 and the corresponding entrance time. If the turnstile system 300 is at the exit 116 or 124 of the coverage area 102, the central server processor 602 updates the last recorded location field 826 to reflect that the guest has exited the coverage area 102 and the corresponding exit time.

With regard to updating the event data object 1000, the central server processor 602 updates the average wait times field 1004, the available reservation times 1006, the reservation times field 1008, and the current capacity 1010 when a guest enters a turnstile system pertaining to the event. With regard to updating the average wait times, there may be a first turnstile system located at the beginning of a line to an event and a second turnstile system located at the end of the line to the event. When a guest passes through the first turnstile system, the guest tag identifier and the corresponding time is stored in a sub-field of the average wait time. Then when the guest passes through the second turnstile system, the corresponding time is stored in another sub-field of the average wait time. This is done for all the guests entering the event. The central server processor uses this information to calculate in essentially "real time" the average wait time for the event.

The reservation times field 1008 is also updated when a guest passes through a turnstile system of the event to reflect that the guest has checked in, and thus remove that reservation time from the reservation field 1008. In addition, the current capacity field 1010 is also updated when a guest passes through the first turnstile system to reflect an additional person to the current capacity. The current capacity field may also be updated when the guest passes through the second turnstile system to reflect a reduction to the current capacity of the event.

Referring again to FIG. 12, in step 1218 the entry mechanism of the turnstile system is activated to allow the guest to pass through.

C. Kiosk System—Messages, Reservations, Monetary Groups and Credits

As previously discussed, there may be several kiosk systems, such as kiosk systems 148, 152, 170, 182 and 185, strategically located within the coverage area 102. A kiosk system allows a guest to send and receive messages from other guests and the coverage area establishment, to make reservation for rides, attractions, restaurants and other events, to create a group comprising a plurality of guest members, and purchase, review and redeem monetary credits.

FIG. 13 illustrates a flow diagram of the process operations 1300 of the kiosk system in accordance with the invention. Upon a guest arriving at a kiosk system, in step 1302 the guest positions the identification tag 108 proximate the RFID reader/writer 404 so that it can read the tag identifier from the identification tag 108. Then the guest is presented on the kiosk display 406 with a main menu 1304 that includes four different options to choose from. These options are a messages option 1306 to allow the guest to receive and send messages, a reservations option 1308 to allow the guest to make reservations for rides, attractions, restaurants and other events, a group option 1310 to allow the guest to create a group comprising of a plurality of guest members, and a monetary credits option 1312 to allow the guest to purchase, review and redeem monetary credits.

If the guest chooses the message option 1306 with the use of the touch screen 414 or the keyboard 416, the guest is presented on the kiosk display 406 two more options, a read messages option 1314 to allow the guest to read any received messages and a create messages option 1316 to allow the guest to create and send messages. If the guest chooses the read messages option 1314, in step 1318 the kiosk processor 402 causes the transmission of the tag identifier along with a message request to the central server 168 by way of the network interface 408. Upon receiving the tag identifier and message request by way of its network interface 606, in step 1320 the central server processor 602 accesses the guest data object from the non-volatile memory 604.

In step 1322, the central server processor 402 determines if there are one or more messages present in the received message field 822 of the guest data object 800. If there are no messages, the central server processor sends a "no message" signal to the kiosk system and then the kiosk system 400 returns to the main menu 1304. If there are one or more messages, in step 1324 the central server processor 602 transmits the one or more messages and the corresponding one or more senders' identifiers and names to the kiosk system 400, where the guest can read the one or more messages on the display 406 and optionally print the one or more messages on the printer 412. In step 1326, the kiosk system processor 402 by way of the display 404 prompts the guest to send a reply or not. If the guest chooses not to send a replay, the kiosk system processor 402 causes the display of the main menu 1304 on the display 406. Otherwise, the kiosk system processor 402 presents the guest via the display 406 the create messages option 1316.

If the guest chooses the create messages option 1316, in step 1318 the kiosk processor 402 via the display 406 prompts the guest for the receiver's identifier and/or name, which the guest inputs with the touch screen input device 414 or keyboard 416. In step 1330, the kiosk processor 402 via the display 406 prompts the guest for the desired message, which the guest inputs with the touch screen 414 or keyboard 416. In step 1332, the kiosk processor 402 via the display 406 prompts the guest to confirm the intended receiver and message. If the guest does not confirm, the kiosk processor 402 returns back to create messages option 1316. If the guest confirms, in step 1334 the kiosk processor 402 transmits the guest's identifier, the receiver's identifier, and the message to the central server 168 by way of the network interface 408.

Upon receiving the guest's and receiver's identifiers and the message by way of its network interface 606, in step 1336 the central server processor 602 accesses the receiver's data object from the non-volatile memory 604 and writes the guest's identifier and/or name and message onto the received message field 822 of the receiver's data object. In step 1338, the kiosk system processor 402 via the display 406 asks the guest if an additional message is to be send. If the guest replies in the positive, the kiosk processor 402 causes the display of the create messages option 1316 on the display 406. Otherwise, kiosk system processor 402 causes the display of the kiosk main menu 1304 on the display 406. Messages can be used to locate lost children or adults within the coverage area.

If the guest chooses the reservations option 1308 in the kiosk main menu 1304, in step 1340 the kiosk system processor 402 via the display 406 presents a list of available events (rides, attractions, restaurants, etc.) and requests the guest to select an event. After a guest selects an event with the use of the touch screen input device 414 or keyboard 416, in step 1342 the kiosk system processor 402 causes the transmission of the selected event identifier and a reservation request to the central server 168 via the network interface 408. Upon receiving the selected event identifier and reservation request by way of its network interface 606, in step 1344 the central server processor 602 accesses the event data object 1000 from the non-volatile memory 604 and transmits the information in the available reservation time field 1006 to the kiosk system 400 via the network interface 606.

Once the kiosk system processor 402 receives the available reservation information via the network interface 408 and causes the display of the information on the display 406, in step 1346 the kiosk system processor 402 via the display 406 requests the guest to select a reservation time for the selected event. After the guest selects a reservation time with the use of the touch screen input device 414 or keyboard 416, in step 1348 the kiosk system processor 402 causes the transmission of the guest and event identifiers and selected reservation time to the central server 168 by way of the network interface 406.

Upon receiving the tag and event identifiers and selected reservation time by way of its network interface 606, in step 1350 the central server processor 602 accesses the event data object 1000 and updates the reservation field 1008 with the tag identifier and selected reservation time, as well as transmits a confirmation to the kiosk system 400 by way of the network interface 606. Upon receiving the confirmation via the network interface 406, the kiosk system processor 402 may cause the printing of the reservation information on the printer 412, and prompts the guest via the display 406 if any more reservations are to be made. If so, the kiosk system processor 402 causes the display of the reservation option 1308. Otherwise, the kiosk system processor 402 causes the display of the main menu 1304.

If the guest chooses the group option 1310 in the kiosk main menu 1304 via the touch screen input device 414 or keyboard 416, the kiosk system processor 402 via the display 406 presents the guest a create group option 1354 and an edit group option 1356. If the guest chooses the create group option 1354, in step 1358 the kiosk system processor 406 via the display 406 prompts the guest to enter the guest's password, which the guest inputs using the touch screen input device 414 or the keyboard 416. In step 1360, the kiosk system processor 402 via the display 406 prompts for a new group member to place his/her identification tag proximate the RFID reader/writer 404 in order to read the new member's identifier. Then in step 1362, the kiosk system processor 402 via the display 406 prompts for the entrance of the password pertaining to the new group member, which is inputted using the touch screen input device 414 or keyboard 416. In step 1364, the kiosk system processor 402 via the display 406 prompts for whether the new member is to be considered a master, allowing the member to modify the group information. If the guest's inputs is in the affirmative, in step 1366 the kiosk system processor 1366 sets a master flag for the new member. Otherwise, the process proceeds to step 1368.

In step 1368, the kiosk system processor 402 via the display 406 prompts the guest whether another member is to be added to the group. If the guest's input is in the affirmative, the kiosk system processor 402 returns the routine back to step 1360. Otherwise, in step 1370 the kiosk system processor 402 causes the transmission of the group information (group member identifiers, corresponding passwords, and corresponding master indicators) to the central server 168 by way of the network interface 408. Upon receiving the group information by way of its network interface 606, in step 1372 the central server processor 602 creates a group data object 900 and updates the group identifier field 820 in the guest data object 800 of each of the group members. Once this occurs, the kiosk system processor 402 causes the display of the kiosk main menu 1304 on the display 406.

If the guest chooses the edit group option 1356 using the touch screen input device 414 or keyboard 416, in step 1374 the kiosk system processor 402 via the display 406 prompts the guest whether to add another member to the group or delete a member from the group. If the guest chooses the delete a member option, in step 1367 the kiosk system processor 402 requests the central server 168 to transmit it the group information and subsequently displays the group information on the display 406, then prompts the guest to select a member to be deleted. When the guest has selected a member, in step 1378 the kiosk system processor 402 via the display 406 prompts the guest to input whether another group member is to be deleted. If the guest responds in the affirmative, the kiosk system processor 402 returns to step 1376. Otherwise, in step 1380 the kiosk system processor 402 causes the transmission of the update information (identifiers of the to-be deleted member with a delete request) by way of the network interface 408. Upon receiving the update information by way of its network interface 606, the central server processor 602 updates the group and deleted members data object. Thereafter, kiosk system processor 402 causes the display of the kiosk main menu 1304.

If in step 1374 the guest chooses the add a member option, the kiosk system processor 402 executes steps 1360 through 1368 (even numbers) for each member to be added. After these steps are completed for each additional members, in step 1380 the kiosk system processor 402 causes the transmission of the update information (identifiers of the to-be added members with a add request) by way of the network interface 408. Upon receiving the update information by way of its network interface 606, the central server processor 602 updates the group and added members data object. Thereafter, kiosk system processor 402 causes the display of the kiosk main menu 1304.

A group is treated similarly to a guest. That is, monetary credits can be purchased for use by the members of the group. Also, message can be sent to the group as a whole, being accessible by all group members. In addition, reservations can be made for the entire group. Instead of specifying a guest identifier, a group identifier is specified in purchasing monetary credits, sending messages, and making reservations.

FIG. 14 illustrates the monetary credits process 1400 of the kiosk system in accordance with the invention. The monetary credits process 1400 is also applicable to in-park system terminals 150, 154, and 194. The difference is the kiosk system is unmanned and the guest interacts with the system, whereas in the service terminal, an operator interacts with the system. Another difference is that the kiosk system accepts credit and debit cards, whereas the service terminal accepts cash in addition to credit and debit cards. The following process with regard monetary credits will be explained with respect to a interacting with a kiosk system, but it shall be understood that such process applies to an operator interacting with a service terminal system. Accordingly, if the guest chooses the monetary credits option 1312 in the kiosk main menu 1304 via the touch screen input device 414 or keyboard 416, the kiosk system processor 402 via the display 406 presents the guest with four options: create monetary credits option 1402, add monetary credits option 1404, review monetary credits option 1406 and redeem monetary credits option 1408.

If the guest chooses the create monetary credits option 1402, in step 1410 the kiosk system processor 402 via the display 406 prompts the guest to open a credit card account or enter the amount of monetary credits to be purchased using cash, which the guest inputs using the touch screen input device 414 or keyboard 416. In step 1412, the kiosk system processor 402 via the display 406 prompts the guest for the payment type, which the guest inputs via the touch screen input device 414 or keyboard 416. If the guest chooses the credit card (or debit card) as the payment type, in step 1416 the guest swipes the credit card through the credit card reader 410 and subsequently the kiosk system processor 402 receives the guest's credit card information. Optionally, in step 1418 the kiosk system processor 402 causes an attached digital camera to take a photograph of the guest.

Then, in step 1420 the kiosk system processor 402 causes the transmission of the monetary credits information (tag identifier, amount of monetary credits, credit card information, and guest photograph) to the central server 168 (400) by way of the network interface 408. Upon receiving the monetary credits information by way of its network interface 606, in step 1422 the central server processor 602 requests the credit card authorization. If no authorization is received, the kiosk system processor 402 returns to display the create monetary option 1402. Otherwise, in step 1428 the central server processor 1428 updates the credit card information field 814, the guest digital photograph field 808, and the guest monetary credits field 816 of the guest data object 800. In step 1430, the central server processor 602 causes the transmission of a confirmation to the kiosk system.

As previously discussed, at an in-park service terminal a guest can purchase monetary credits by cash with the use of an operator. Therefore, if in step 1412 the operator receives the cash from the guest. Then in step 1426 the operator enters the amount of monetary credits desired using the touch screen 216 or keyboard 218 and causes the service terminal processor 202 to transmit the monetary credits information (tag identifier and monetary credits purchased) to the central processor 168 (400) by way of the network interface 208. Upon receiving the monetary credits information by way of its network interface 606, in step 1428 the central server processor 602 updates the available monetary credits field 816 of the guest data object. In step 1430, the central server processor 602 causes the transmission of a confirmation to the service terminal system.

If the guest chooses the add monetary credits option 1404, in step 1432 the kiosk system processor 402 via the display 406 prompts the guest to enter the amount of monetary credits to be purchased, which the guest inputs using the touch screen input device 414 or keyboard 416. In step 1434, the kiosk system processor 402 via the display 406 prompts the guest for the payment type, which the guest inputs via the touch screen input device 414 or keyboard 416. If the guest chooses the credit card (or debit card) as the payment type, in step 1436 the kiosk system processor 402 causes the transmission of the monetary credits information (tag identifier and amount of monetary credits desired) to the central server 168 (400) by way of the network interface 408.

Upon receiving the monetary credits information by way of its network interface 606, in step 1438 the central server processor 602 requests the credit card authorization for the additional amount. If no authorization is received, the kiosk system processor 402 returns to display the add monetary credits option 1404. Otherwise, in step 1444 the central server processor 602 updates the guest available monetary credits field 816 of the guest data object 800. In step 1446, the central server processor 602 causes the transmission of a confirmation to the kiosk system, which subsequently prints the transaction with the printer 412.

As previously discussed, at an in-park service terminal a guest can add monetary credits by cash with the use of an operator. Therefore, if in step 1440 the operator receives the cash from the guest. Then in step 1442 the operator enters the amount of monetary credits desired using the touch screen 216 or keyboard 218 and causes the service terminal processor 202 to transmit the monetary credits information (tag identifier and monetary credits purchased) to the central processor 168 (400) by way of the network interface 208. Upon receiving the monetary credits information by way of its network interface 606, in step 1444 the central server processor 602 updates the available monetary credits field 816 of the guest data object. In step 1446, the central server processor 602 causes the transmission of a confirmation to the service terminal system, which subsequently prints the transaction with the printer 214.

If the guest chooses the review monetary credits option 1448, in step 1448 the kiosk system processor 402 causes the transmission of the tag identifier and a request for the monetary credits information to the central processor 168 (400) by way of the network interface 408. Upon receiving the tag identifier and request by way of its network interface 606, the central server processor 602 accesses and reads the available monetary credits field 816 of the guest data object 800 and transmits that information back to the kiosk system for displaying to the guest.

If the guest chooses the redeem monetary credits/close account option 1408, the kiosk system processor 402 via the display 406 prompts the guest to enter the redemption type (credit card, cash). In step 1454, the kiosk system processor 402 causes the transmission of the tag identifier, redemption type, and a request for redemption to the central server 168 (400) by way of the network interface 408. Upon receiving the tag identifier, redemption type and request by way of its network interface 606, in step 1456 the central server processor 602 determines the redemption type. If the guest has a credit card account and wants to close out the account, in step 1458 the central server processor 602 access the guest data object 800 and causes a charge in the amount listed in the monetary credits field 816 to the guest's credit card account as provided in the credit card information field 812 and updates the guest data object 800 by setting to zero the monetary credits field 816. Then in step 1460, the central server processor 602 transmits a confirmation back to the kiosk system, which prints the transaction confirmation on the printer 412.

As previously discussed, at an in-park service terminal a guest can redeem monetary credits in cash with the use of an operator. Accordingly, if in step 1456 the central server processor 602 determines that the redemption type is cash, then in step 1462 the central server processor 602 reads the available monetary credits field 816 of the guest data object 800, transmits that information back to the service terminal, and updates the guest data object 800 by setting to zero the available monetary credits field 816. In step 1464, the operator at the service terminal pays the guest in cash, venue credit, or coupon. Then in step 1466, the central server processor 602 transmits a confirmation, which prints the transaction on the printer 412.

D. Point-of-Sale (POS System)—Monetary Credits Transactions

As previously discussed, the network computer system 100 of the invention includes a plurality of point-of-sale (POS) systems 174 and 188 typically located at gift shops 172 and restaurants 186 including a mobile POS system 184 located in a food cart or the like. The POS systems allow a guest to purchase items and services at commercial establishments within the coverage area 102 using monetary credits. That is, merely by having the guest select the item or service desired and have the guest identification tag read by an RFID reader/writer, the transaction can be completed with the central server updating the guest data object to deduce the sale price of the item or service from the available monetary credits field of the guest data object.

Figure 15:
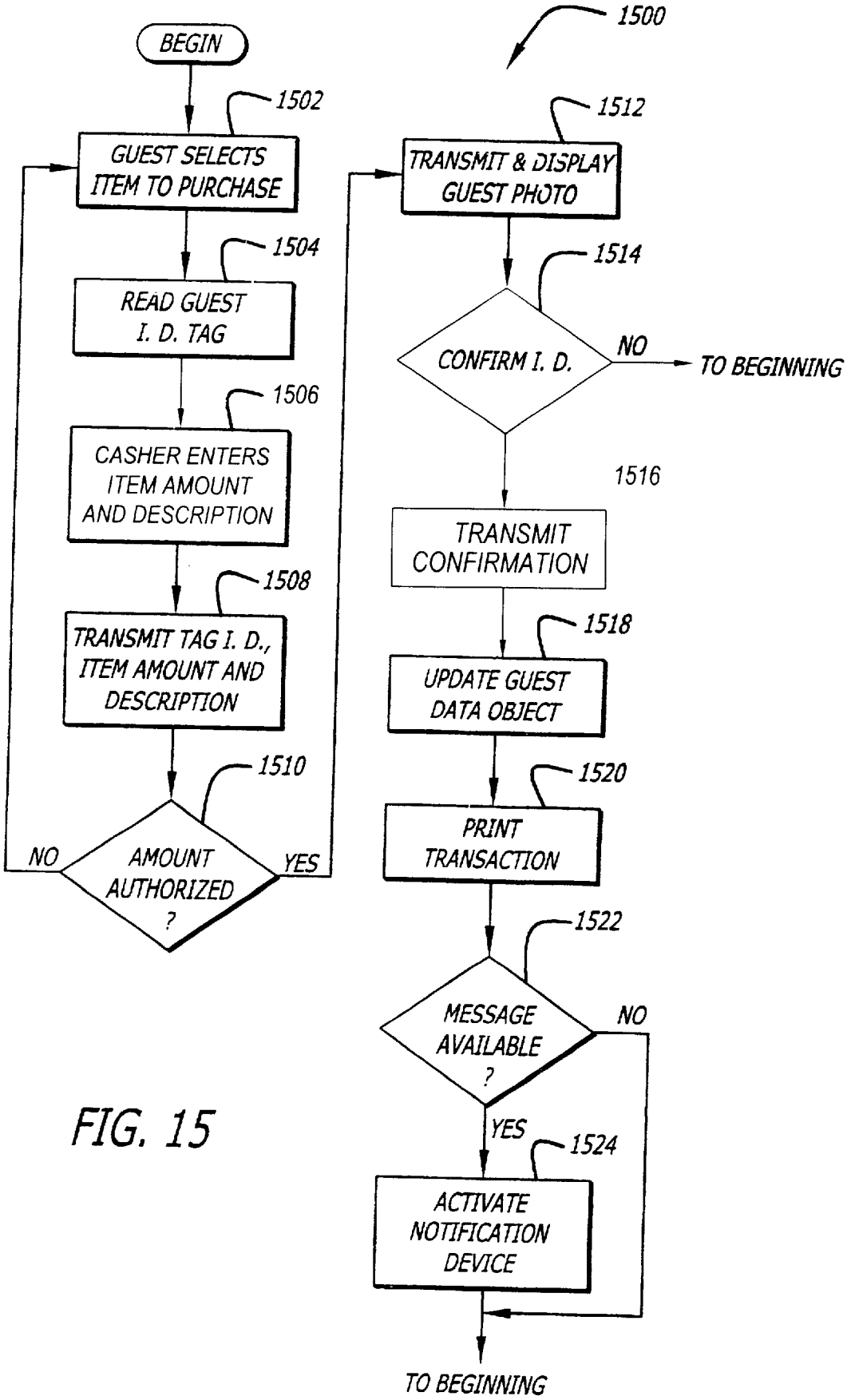
FIG. 15 illustrates a flow diagram of an exemplary operations process of a point-of-sale (POS) system in accordance with the invention.

FIG. 15 illustrates a flow diagram of an exemplary operations process 1500 of a POS system in accordance with the invention. The operations process 1500 shall be explained using the purchasing of an item as an example. It shall be understood that the operations process 1500 also applies to the purchasing of services within the coverage area 102. In step 1502, a guest selects an item to purchase. In step 1504, the guest presents the item at a POS system and the guest's identification tag is then read by the RFID reader/writer 504. In step 1506, the item identification may be scanned with a bar code scanner 710 or can be manual inputted into the POS system by a cashier. In step 1508, the POS system processor 502 causes the transmission of the tag identifier, item description and amount along with a transaction request to the central server 168 (400) by way of the network interface 508.

Upon receiving the tag identifier, item description and amount by way of its network interface 606, in step 1510 the central server processor 602 access the guest data object 800 and determines if there is sufficient available monetary credits in data field 816 to cover the amount for the item. If there are insufficient monetary credits, the central server processor 602 informs the POS system accordingly, and the process 1500 returns to step 1502. If there is sufficient monetary credits, in step 1512 the central server processor 602 accesses and causes the transmission to the POS system of the guest's photo from the guest digital photograph field 808 of the guest data object 800. The guest's photograph is then shown on the display 506 of the POS system 500.

Then in step 1514, the POS system processor 502 prompts the cashier to confirm that the buyer matches the guest's photograph. If the cashier does not, the process returns back to 1502. If it does, in step 1516 the cashier causes the POS system processor 502 to transmit a confirmation message to the central server 168 (400) by way of the network interface 508. Upon receiving the confirmation message by way of the network interface 606, the central server processor 1518 updates the guest data object 800 to deduct/adds the sale price to the monetary credits in data field 816 and also update the purchases field 824 with the item description. In step 1520, the central server processor 602 transmits back to the POS system 500 confirming the completion of the transaction, which the POS system processor 502 subsequently causes the printing of the transaction detail by the printer 510. Steps 1522 and 1524 relates to notifying a guest of a received message as previously discussed.

E. Marketing Data Collection

In addition to facilitating transactions in the coverage area 102 with the use of electronic credits, the network computer system 100 is particularly useful for gathering statistical, demographic, and in-coverage area transaction information from each guest, but it can also use this information to generate marketing reports and analysis which can be used for advertising and modifying the services and products provided to the guests. The guest data object 800 includes in data field 806 statistical and demographic information about the guest and in data field purchases and event attendance undergone by the guest during a daily activity. The central server 168 accumulates the guest data object for all the guests in attendance, and periodically or at the end of a session, transmits the data to the data center server 180 for generating marketing reports and analysis that correlate the statistical and demographic information with the transaction information. These reports and analysis can be used for marketing, advertising, and tailoring of products and services.

Referring again to FIG. 1 and for example, the data center server 180 can determine the statistical and demographic make-up of the people that go on attraction ride "A" with the use of the statistical and demographic information field 806 of the guest data object 800. It also knows what products and services the guests have purchased and events attended with the use of the purchases and event attendance field 824 of the guest data object 800. Thus, this information, the coverage area establishment can tailor the products and/or services of the gift shop 172 at the exit of attraction ride "A" to coincide with the historical purchasing information of these guests. This would most likely increase the profitability of the gift shop 172. This is merely an example of the power capability of the network computer system 100 of the invention.

The network computer system of the invention can also perform essentially "real time" marketing analysis and decisions. For example, the central server 168 can monitor the recent locations of people within the coverage area 102 at any given time. That is, every time a guest has its electronic tag 108 read by a R/W head, the location of the guest is updated in the last recorded location field 824 of the guest data object 800. With the use of the recent location information, statistical and demographic information, and historical purchasing information in essentially "real time", the central server 168 can direct mobile POS system cart 184 (e.g. an ice cream cart) via a wireless medium to go to the region of the coverage area 102 where it would most profitable. Again, this is merely an example of "real time" marketing analysis and decision, and others are possible with the network computer system 100 of the invention.

In summary, the network computer system 100 of the invention is very useful for marketing, advertising and product and service development.

F. Access by Internet

The network computer system 100 of the invention can also include a communications link to the Internet 169 to allow guests to access a website sponsored by the coverage area establishment. The website can be used for many purposes. For instance, at many attraction rides, photographs of the guests on rides are taken for possibly later purchase by the guests. With the use of the guest identification tag 108, the guest can cause the network computer system 100 to save the photograph for later downloading by way of the Internet 169. The guest can use the electronic tag's identification number, name and password to later purchase the photograph through the website. Also, the guest purchase monetary credits and have guest data object via the internet, thus expediting the entrance time to the coverage area. Additionally, the guest can set up groups and masters using the web-site before entering the park. There are many other functions that can be performed by means of the Internet 169.

V. Conclusion

In the foregoing specification, the invention has been described with reference to specific embodiments thereof. It will, however, be evident that various modifications and changes may be made thereto departing from the broader spirit and scope of the invention. The specification and drawings are, accordingly, to be regarded in an illustrative rather than a restrictive sense.

What is claimed is:

1. A method of preventing a child-guest from exiting a coverage area without an authorized adult-guest, comprising:

creating a child-guest data object including a first data field containing information related to an identity of said child-guest, a second data field containing information related to an identity of said authorized adult-guest, and a third data field containing information related to monetary credits available for use in purchasing items within said coverage area;

reading a first tag identifier from a first tag worn by said child-guest;

reading a second tag identifier from a second tag worn by an adult accompanying said child-guest only if said first tag identifier identifies a child;

accessing said child-guest data object using said first tag identifier;

comparing said second tag identifier to said information related to an identity of said authorized adult-guest; and allowing said child to exit said coverage area if said second tag identifier correlates with said information related to said identity of said authorized adult-guest, or preventing said child from exiting said coverage area if said second tag identifier does not correlate with said information related to said identity of said authorized adult-guest.

2. The method of claim 1, wherein said first and second tags comprises radio frequency identification (RFID) tags.

3. The method of claim 2, wherein reading said first and second tag identifiers respectively from said first and second tags comprises using an RFID reader to read said first and second tag identifiers.

4. The method of claim 1, further comprising transmitting said first and second tag identifiers from a turnstile system to a central server by way of a communications link.

5. The method of claim 4, wherein a central server processor of said central server receives said first and second tag identifiers, accesses said child-guest data object using said first tag identifier, and compares second tag identifier to said information related to said identify of said authorized adult-guest.

6. The method of claim 5, wherein said central server transmits a control signal to said turnstile system to activate an entry mechanism to allow said child-guest to exit said coverage area if said second tag identifier correlates with said information related to said identify of said authorized adult-guest.

7. The method of claim 1, wherein said child-guest data object further comprises a third data field containing information related to statistical information regarding said child-guest, and further comprising determining that said child-guest is a child by accessing said third data field.

8. The method of claim 7, further comprising requesting said reading of said second tag identifier from said second tag worn by said adult if it is determined that said child-guest is a child.

9. The method of claim 1, wherein said child-guest data object further comprises a third data field containing information related to a current location of said child-guest, and further comprising modifying said third data field so that said current location of said child indicates that said child is outside of said coverage area if said child is allowed to exit said child area.

* * * * *